US006269761B1

(12) United States Patent
Abraham et al.

(10) Patent No.: US 6,269,761 B1
(45) Date of Patent: Aug. 7, 2001

(54) BUOYANCY DEVICE

(75) Inventors: Arthur Graham Abraham, Aberdeen; Ian James Murray, Torphins; Stephen Halden Johnson, Banchory, all of (GB)

(73) Assignee: Controlled Variable Buoyancy Systems Limited, Kinellar (GB)

( * ) Notice: Subject to any disclaimer, the term of this patent is extended or adjusted under 35 U.S.C. 154(b) by 0 days.

(21) Appl. No.: 09/193,021

(22) Filed: Nov. 16, 1998

Related U.S. Application Data

(63) Continuation-in-part of application No. PCT/GB97/01350, filed on May 16, 1997.

(30) Foreign Application Priority Data

May 16, 1996 (GB) ..... 9610216

(51) Int. Cl.[7] ..... B63B 43/14
(52) U.S. Cl. ..... 114/123; 114/54; 405/203
(58) Field of Search ..... 114/50, 52, 54, 114/123, 333, 360; 441/133; 405/195.1, 203, 206

(56) References Cited

U.S. PATENT DOCUMENTS

| | | | | |
|---|---|---|---|---|
| 1,332,433 | * | 3/1920 | Deam | 114/54 |
| 1,486,131 | * | 3/1924 | Dutton | 114/54 |
| 1,554,316 | * | 9/1925 | Winship | 114/54 |
| 2,179,125 | * | 11/1939 | Kirlin | 114/54 |
| 3,064,437 | * | 11/1962 | Knapp | 405/206 |
| 3,067,712 | | 12/1962 | Doerpinghaus . | |
| 3,090,976 | * | 5/1963 | Liu | 114/54 |
| 3,289,721 | | 12/1966 | Benson . | |
| 3,512,493 | | 5/1970 | Hallanger | 114/53 |
| 3,818,523 | * | 6/1974 | Stillman, Jr. | 114/333 |
| 3,942,456 | * | 3/1976 | Dinglinger | 114/333 |
| 3,946,685 | * | 3/1976 | Chadbourne et al. | 114/333 |
| 4,063,526 | | 12/1977 | Ueda | 114/220 |
| 4,458,618 | * | 7/1984 | Tuffier | 114/360 |

FOREIGN PATENT DOCUMENTS

| | | |
|---|---|---|
| 9414255 | 12/1994 | (DE) . |
| 2654409A1 | 5/1991 | (FR) . |
| 2721579A1 | 12/1995 | (FR) . |
| 2120606A | 12/1983 | (GB) . |

* cited by examiner

*Primary Examiner*—Sherman Basinger
(74) *Attorney, Agent, or Firm*—Ratner & Prestia

(57) ABSTRACT

A buoyancy device is described comprising a number of buoyancy members (9, 9A, 9B) which are substantially equi-spaced around the circumference of a coupling member (7) and the buoyancy members (9, 9A, 9B) being coupled to the coupling member (7) At least two of the buoyancy members (9, 9A, 9B) are inflatable members (9, 9A, 9B). The inflatable members (9, 9A, 9B) are formed from a substantially flexible material such that an inflatable member (9, 9A, 9B) substantially collapses when deflated. The coupling member (7) is is typically coupled to a structure, which may be a drilling rig (3) which requires to be lifted and subsequently moved, or which may be a large device such as a well head Christmas tree for an oil well which requires to be deployed in deep water.

43 Claims, 17 Drawing Sheets

A - Air supply/venting ext. plug
B - Bottle recharging ext. plug
C - Automation cable inlet (for master module only)
D - Automation plug to link slave modules

BUOYANCY DEVICE

This application is a Continuation-in-Part Application of prior PCT International Application No. PCT/GB97/01350 filed May 16, 1997.

The present invention relates to a buoyancy device particularly, but not exclusively, for attachment to large structures requiring to be lifted, lowered, positioned and transported via the ocean.

Conventionally, when an offshore drilling structure comes to the end of its working life, it is decommissioned. In the past, it was thought that decommissioning could entail sinking the drilling structure at the point where it once stood.

However, amongst other factors, environmental factors have recently increased the need for offshore drilling structures to be moved to shallower and calmer waters, or back on land so that the drilling structures can be dismantled safely.

Previously, moving the drilling structures has involved the use of flat back barges, onto which the drilling structures are hauled. However, these barges are expensive and costly in terms of man power requirements.

According to the present invention there is provided a buoyancy device comprising a plurality of buoyancy members substantially equi-spaced around the circumference of a coupling member, the buoyancy members being coupled to the coupling member, wherein at least two of the buoyancy members are inflatable members, the inflatable members being formed from a substantially flexible material, such that the inflatable member substantially collapses when deflated.

Preferably, the coupling member is coupled to a structure required to be moved in water, in use.

Typically the coupling member is a tubular member and the inflatable members may be coupled along the length of the tubular member.

Typically, the tubular member is substantially horizontal in use, when coupled to the structure required to be lifted, and after the inflatable members have been inflated.

Typically, the tubular member is coupled to the structure when the inflatable members are deflated.

Preferably, the tubular member is coupled to the structure in an initially horizontal plane.

Alternatively, the tubular member is initially coupled to the structure such that longitudinal axis of the tubular member is approximately 45° to the horizontal plane.

Preferably, the inflatable member comprises an outer skin of substantially flexible material, the outer skin defining an inner space, the outer skin comprising a body section, and an end section being sealably coupled to both ends of the body section. Preferably, the body and end sections comprise base edges by means of which the inflatable member is coupled to the tubular member. The base edges of the inflatable member may be spaced apart, and preferably, an inflation means inlet and a deflation means outlet are located between the spaced apart base edges.

Preferably, coupling devices are provided to couple the base edges of the inflatable members to the tubular member, and more preferably, a coupling device couples one side member of the body section of a first inflatable member in a back to back relationship with a side member of the body section of a second inflatable member. An inflatable member may have a cross-section which is substantially U-shaped, in use, when inflated.

This provides the invention with the advantage that the spaced apart base edges couple the inflatable member to the tubular member, and also provide access to the inner space from the tubular member to inflate or deflate the inflatable member. Thus, the outer skin of the inflatable member does not require to be pierced in order to provide access to the inner space.

Alternatively, the base edges of the inflatable member may be conjoined, and the inflatable members may be substantially wedge-shaped, in use, when inflated. The inflatable members may be movably coupled in a circumferential direction to the tubular member.

Preferably, the buoyancy device further comprises a pressure sensor to sense the pressure in the surrounding water, and may further comprise a displacement sensor to measure the displacement of the buoyancy device, and may further comprise an acceleration sensor to measure the acceleration of the buoyancy device.

Preferably, there is provided a pressure sensor to sense the pressure within each inflatable member.

Typically, there is provided at least one valve to allow regulation of the pressure within an inflatable member. Preferably, there is at least one inflation valve to allow the pressure of air within each inflatable member to be increased and preferably, there is at least one deflation valve to allow the pressure of air within each inflatable member to be decreased.

Preferably, should one or more of the inflatable members deflate, the pressure within the remaining inflatable members may be increased to compensate for the deflated members. Preferably, the inflatable members are restrained from over-inflation by a restraining device.

Preferably, the buoyancy device further comprises a control system to allow variation of its buoyancy. More preferably, a number of inflatable members are provided with a control system to allow variation of the buoyancy of the inflatable members.

Preferably, the control system is connected to, and reads signals from, the surrounding water pressure sensor, the inflatable member pressure sensor, the displacement sensor and the acceleration sensor. More preferably, the control system varies the buoyancy of the inflatable member in response to the signals read.

Typically, when the pressure within the remaining inflatable members is increased, the remaining inflatable members increase in size to occupy the space left by the deflated member(s).

One or more of the inflatable members may be inflated by air. Alternatively, one or more of the inflatable members are inflated with an incompressible material having a density less than that of the surrounding water. Typically, the inflatable members are inflatable bags.

According to a further aspect of the present invention there is provided a buoyancy device comprising at least one buoyancy member optionally connected to a coupling member for attachment of the coupling member to a structure to be floated, wherein the buoyancy member is inflatable and comprises a substantially flexible portion and one or more end portions, the or each end portion being releasably attached to the flexible portion.

The end portions may be dome-shaped, and the flexible portion may be tubular and may extend between two end portions. The dome-shaped end portions may be arranged in a first configuration in which their convex portions face one another, or may be arranged in a second configuration in which their concave portions are facing one another. The end portions may be connected together by any suitable connector, eg by straps or chains etc. The connectors may have tensioning devices incorporated in order to alter the tension and this can in some embodiments be carried out when the end portions are connected in situ. The end portions can have ports to allow access to the interior of the device.

The end portions can be connected to the flexible portions, for instance, at a section of overlap between the two portions. The flexible portion preferably overlies a respective end portion at said overlap, but this may be reversed. The flexible portion can be hooked onto the end portion, or in a preferred embodiment has bands extending around the flexible portion at the overlap, so as to tighten the band around the flexible portion and compress it against the end portion. One or more bands can be provided, preferably of steel or plastics material, and preferably of an inextensible material.

The invention also provides a buoyancy device comprising an array of buoyancy members connected to a coupling member for attachment to a structure to be floated, wherein the coupling member is disposed at one or more ends of the buoyancy members.

In this embodiment the coupling member can be a plate extending between at least two buoyancy members at an end thereof. The plate can be a simple bar extending between two members which can be adjacent, or can be a lattice which connects a number of adjacent or nonadjacent members in the array.

The invention also provides a buoyancy device comprising a chamber having a variable buoyancy, and means to vary the buoyancy of said chamber.

The chamber preferably comprises an extensible portion which can be expanded or contracted to increase or decrease the buoyancy of the chamber.

The means to vary the buoyancy of the chamber can be a gas cylinder optionally located in the chamber itself, although this is not necessary. The gas cylinder can be charged with any suitable type of gas more buoyant than the fluid in which the device is to be used. The device can comprise an array of such chambers, or a mixture of variable-buoyancy chambers and other buoyancy members which do not have variable buoyancy means. The device is preferably arranged with an array of buoyancy members comprising an inner ring of members and an outer ring of members, the buoyancy of the outer ring members optionally being non-variable, and that of the inner ring members being preferably variable, but some other arrangement of variable/non-variable members may be used. The buoyancy of the variable members is preferably variable from outwith the device, and for this purpose the device may have external control means.

The buoyancy members can be inflatable and have a substantially flexible portion and one or more end portions, the or each end portion being releasably attached to the flexible portion as previously described.

Typically, the coupling member is a tubular member and the buoyancy members may be coupled along the length of the tubular member, or may be coupled to the ends of the tubular member.

Typically, the tubular member is substantially horizontal in use, when coupled to the structure required to be lifted, and after the buoyancy members have been inflated.

Typically, the tubular member is coupled to the structure when the buoyancy members are deflated. Preferably, the tubular member is coupled to the structure in an initially horizontal plane.

Alternatively, the tubular member is initially coupled to the structure such that longitudinal axis of the tubular member is approximately 45° to the horizontal plane.

An inflation means inlet and/or a deflation means outlet may be located at one or both of the end portions.

The buoyancy device may further comprise a pressure sensor to sense the pressure in the surrounding water, and may further comprise a displacement sensor to measure the displacement of the buoyancy device, and may further comprise an acceleration sensor to measure the acceleration of the buoyancy device.

A pressure sensor may be provided to sense the pressure within each inflatable member.

Typically, there is provided at least one valve to allow regulation of the pressure within an inflatable member. There may be at least one inflation valve to allow the pressure of air within each inflatable member to be increased and there may be at least one deflation valve to allow the pressure of air within each inflatable member to be decreased.

Preferably, should one or more of the inflatable members deflate, the pressure within the remaining inflatable members may be increased to compensate for the deflated member(s). Preferably, the inflatable members are restrained from over-inflation by a restraining device.

Preferably, the buoyancy device further comprises a control system to allow variation of its buoyancy. More preferably, a number of inflatable members are provided with a control system to allow variation of the buoyancy of the inflatable members.

Preferably, the control system is connected to, and reads signals from, the surrounding water pressure sensor, the inflatable member pressure sensor, the displacement sensor and the acceleration sensor. More preferably, the control system varies the buoyancy of the inflatable member in response to the signals read.

One or more of the inflatable members may be inflated by air. Alternatively, one or more of the inflatable members are inflated with an incompressible material having a density less than that of the surrounding water. Typically, the inflatable members are inflatable bags.

Our previous PCT application GB97/01350 concerns a type of buoyancy device upon which the present invention seeks to improve which is incorporated by reference.

According to one aspect of the present invention there is provided a buoyancy device comprising at least one buoyancy member optionally connected to a coupling member for attachment of the coupling member to a structure to be floated, wherein the buoyancy member is inflatable and comprises a substantially flexible portion and one or more end portions, the or each end portion being releasably attached to the flexible portion.

The end portions may be dome-shaped, and the flexible portion may be tubular and may extend between two end portions. The dome-shaped end portions may be arranged in a first configuration in which their convex portions face one another, or may be arranged in a second configuration in which their concave portions are facing one another. The end portions may be connected together by any suitable connector, eg by straps or chains etc. The connectors may have tensioning devices incorporated in order to alter the tension and this can in some embodiments be carried out when the end portions are connected in situ. The end portions can have ports to allow access to the interior of the device.

The end portions can be connected to the flexible portions, for instance, at a section of overlap between the two portions. The flexible portion preferably overlies a respective end portion at said overlap, but this may be reversed. The flexible portion can be hooked onto the end portion, or in a preferred embodiment has bands extending around the flexible portion at the overlap, so as to tighten the band around the flexible portion and compress it against the end portion. One or more bands can be provided, preferably of steel or plastics material, and preferably of an inextensible material.

The invention also provides a buoyancy device comprising an array of buoyancy members connected to a coupling member for attachment to a structure to be floated, wherein the coupling member is disposed at one or more ends of the buoyancy members.

In this embodiment the coupling member can be a plate extending between at least two buoyancy members at an end thereof. The plate can be a simple bar extending between two members which can be adjacent, or can be a lattice which connects a number of adjacent or nonadjacent members in the array.

The invention also provides a buoyancy device comprising a chamber having a variable buoyancy, and means to vary the buoyancy of said chamber.

The chamber preferably comprises an extensible portion which can be expanded or contracted to increase or decrease the buoyancy of the chamber.

The means to vary the buoyancy of the chamber can be a gas cylinder optionally located in the chamber itself, although this is not necessary. The gas cylinder can be charged with any suitable type of gas more buoyant than the fluid in which the device is to be used. The device can comprise an array of such chambers, or a mixture of variable-buoyancy chambers and other buoyancy members which do not have variable buoyancy means. The device is preferably arranged with an array of buoyancy members comprising an inner ring of members and an outer ring of members, the buoyancy of the outer ring members optionally being non-variable, and that of the inner ring members being preferably variable, but some other arrangement of variable/non-variable members may be used. The buoyancy of the variable members is preferably variable from outwith the device, and for this purpose the device may have external control means.

The buoyancy members can be inflatable and have a substantially flexible portion and one or more end portions, the or each end portion being releasably attached to the flexible portion as previously described.

Typically, the coupling member is a tubular member and the buoyancy members may be coupled along the length of the tubular member.

Typically, the tubular member is substantially horizontal in use, when coupled to the structure required to be lifted, and after the buoyancy members have been inflated.

Typically, the tubular member is coupled to the structure when the buoyancy members are deflated. Preferably, the tubular member is coupled to the structure in an initially horizontal plane.

Alternatively, the tubular member is initially coupled to the structure such that longitudinal axis of the tubular member is approximately 45° to the horizontal plane.

Preferably, the member comprises an outer skin of substantially flexible material, the outer skin defining an inner space, the outer skin comprising a body section, and an end section being sealably coupled to both ends of the body section. Preferably, the body and end sections comprise base edges by means of which the inflatable member is coupled to the tubular member. The base edges of the inflatable member may be spaced apart, and preferably, an inflation means inlet and a deflation means outlet are located between the spaced apart base edges.

Preferably, coupling devices are provided to couple the base edges of the inflatable members to the tubular member, and more preferably, a coupling device couples one side member of the body section of a first inflatable member in a back to back relationship with a side member of the body section of a second inflatable member. An inflatable member may have a cross-section which is substantially U-shaped, in use, when inflated.

This provides the invention with the advantage that the spaced apart base edges couple the inflatable member to the tubular member, and also provide access to the inner space from the tubular member to inflate or deflate the inflatable member. Thus, the outer skin of the inflatable member does not require to be pierced in order to provide access to the inner space.

Alternatively, the base edges of the inflatable member may be conjoined, and the inflatable members may be substantially wedge-shaped, in use, when inflated. The inflatable members may be movably coupled in a circumferential direction to the tubular member.

Preferably, the buoyancy device further comprises a pressure sensor to sense the pressure in the surrounding water, and may further comprise a displacement sensor to measure the displacement of the buoyancy device, and may further comprise an acceleration sensor to measure the acceleration of the buoyancy device.

Preferably, there is provided a pressure sensor to sense the pressure within each inflatable member.

Typically, there is provided at least one valve to allow regulation of the pressure within an inflatable member. Preferably, there is at least one inflation valve to allow the pressure of air within each inflatable member to be increased and preferably, there is at least one deflation valve to allow the pressure of air within each inflatable member to be decreased.

Preferably, should one or more of the inflatable members deflate, the pressure within the remaining inflatable members may be increased to compensate for the deflated members. Preferably, the inflatable members are restrained from over-inflation by a restraining device.

Preferably, the buoyancy device further comprises a control system to allow variation of its buoyancy. More preferably, a number of inflatable members are provided with a control system to allow variation of the buoyancy of the inflatable members.

Preferably, the control system is connected to, and reads signals from, the surrounding water pressure sensor, the inflatable member pressure sensor, the displacement sensor and the acceleration sensor. More preferably, the control system varies the buoyancy of the inflatable member in response to the signals read.

Typically, when the pressure within the remaining inflatable members is increased, the remaining inflatable members increase in size to occupy the space left by the deflated member(s).

One or more of the inflatable members may be inflated by air. Alternatively, one or more of the inflatable members are inflated with an incompressible material having a density less than that of the surrounding water. Typically, the inflatable members are inflatable bags.

Embodiments of the present invention will now be described, by way of example only, and with reference to the accompanying drawings, in which.

Figure 1:
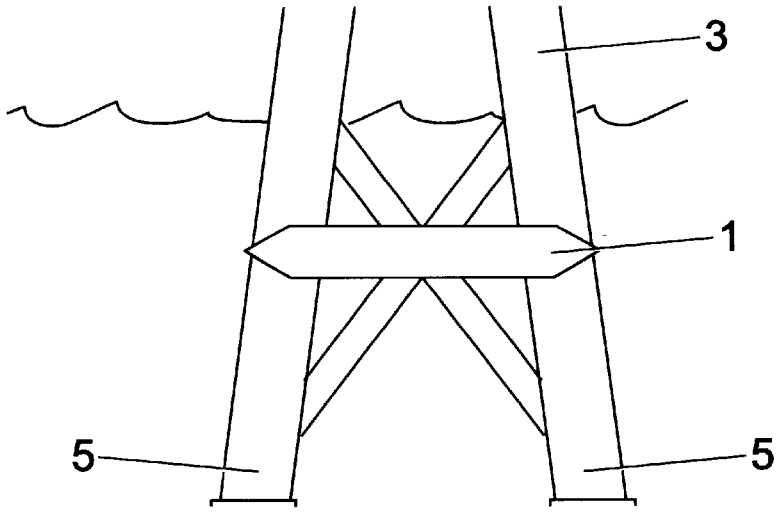
FIG. 1 is a perspective view of an uninflated lifting device attached in a first arrangement to a drilling structure.
Figure 4A:
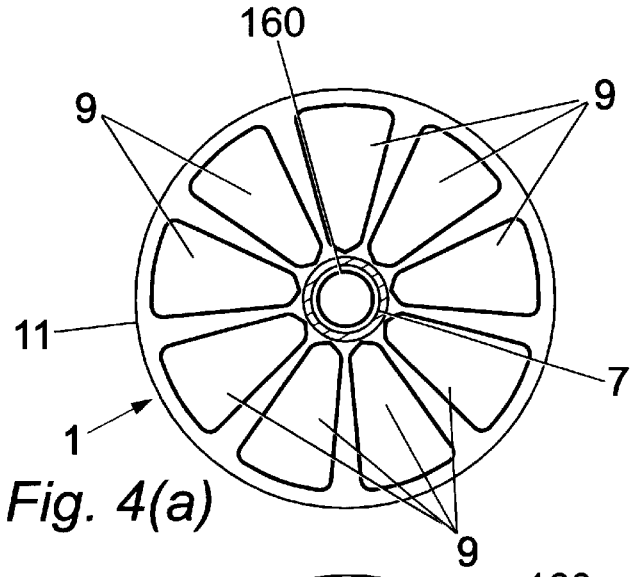
Figure 4B:
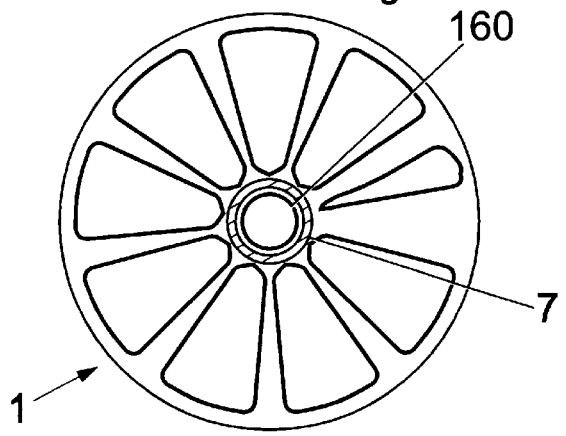
Figure 4C:
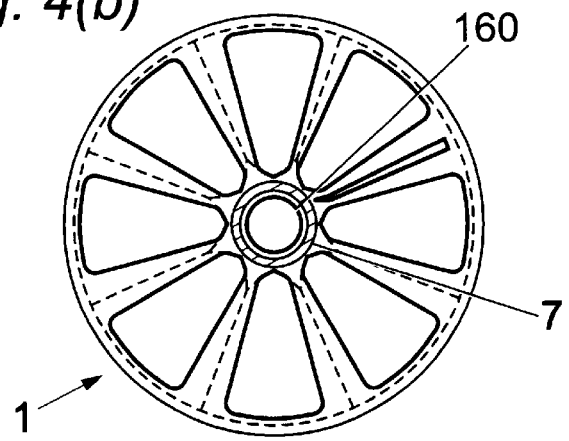
Figure 5:
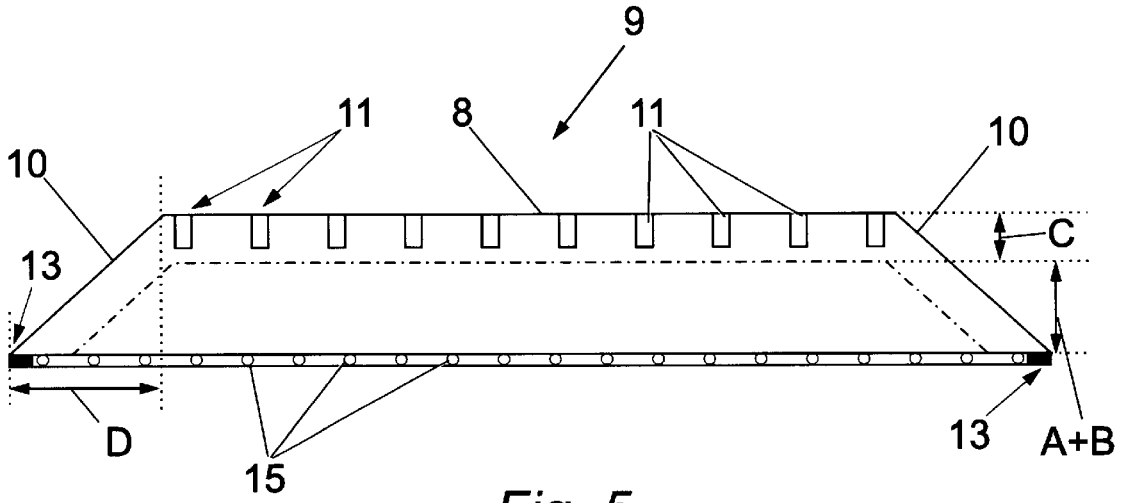
Figure 6:
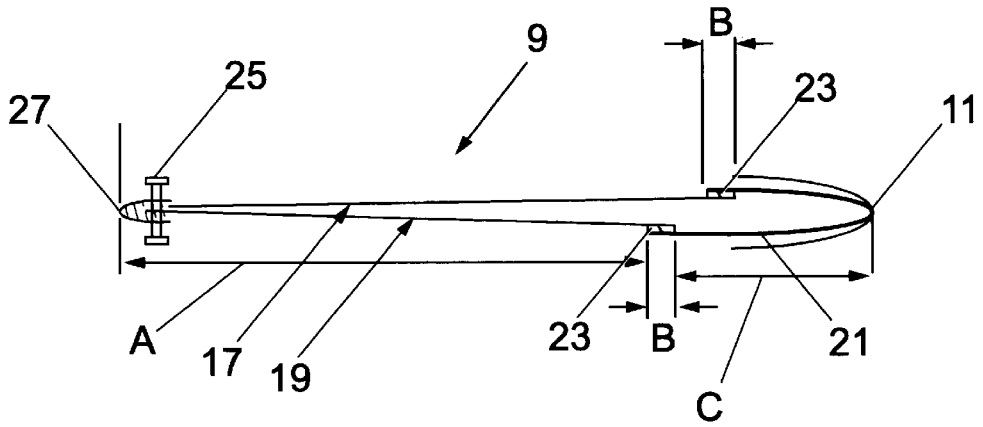
Figure 7:
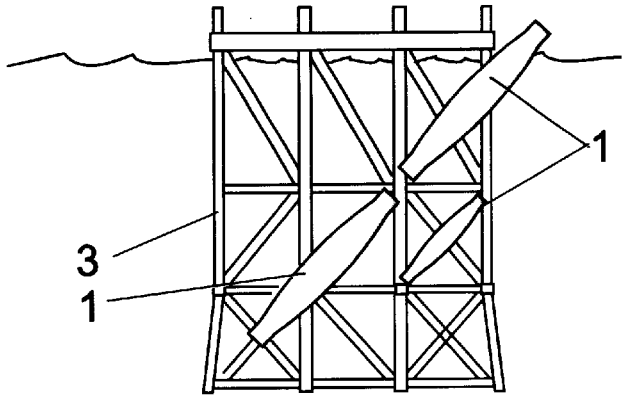
Figure 8:
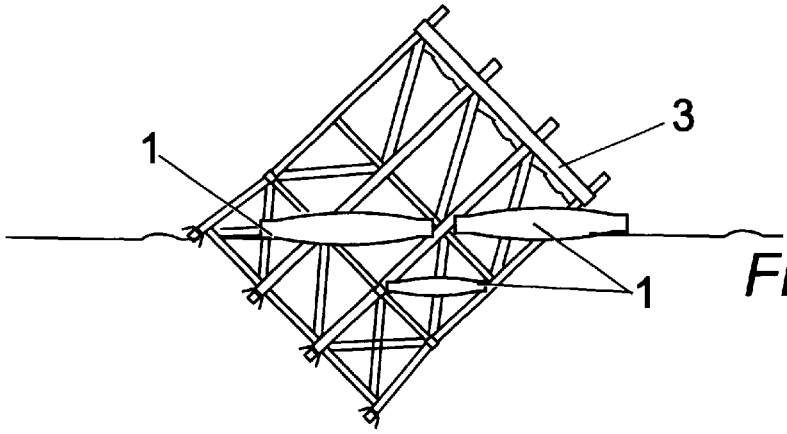
Figure 9:
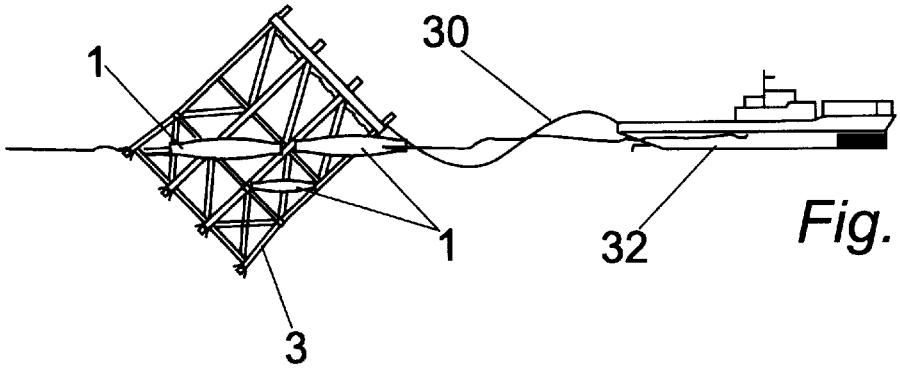
Figure 10:
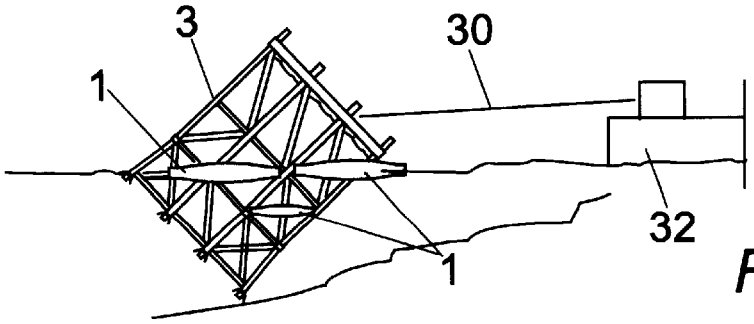
Figure 11:
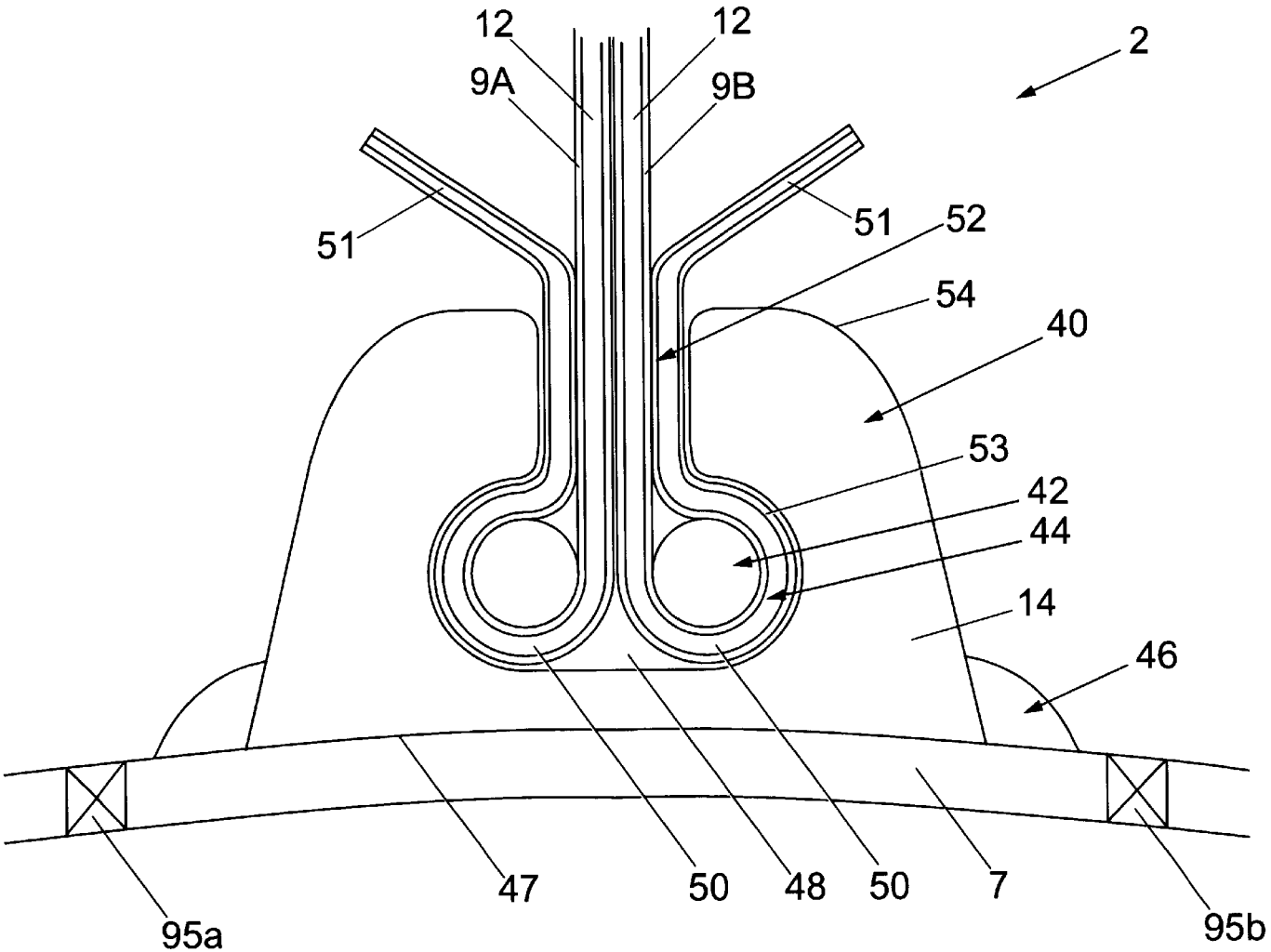
Figure 12:
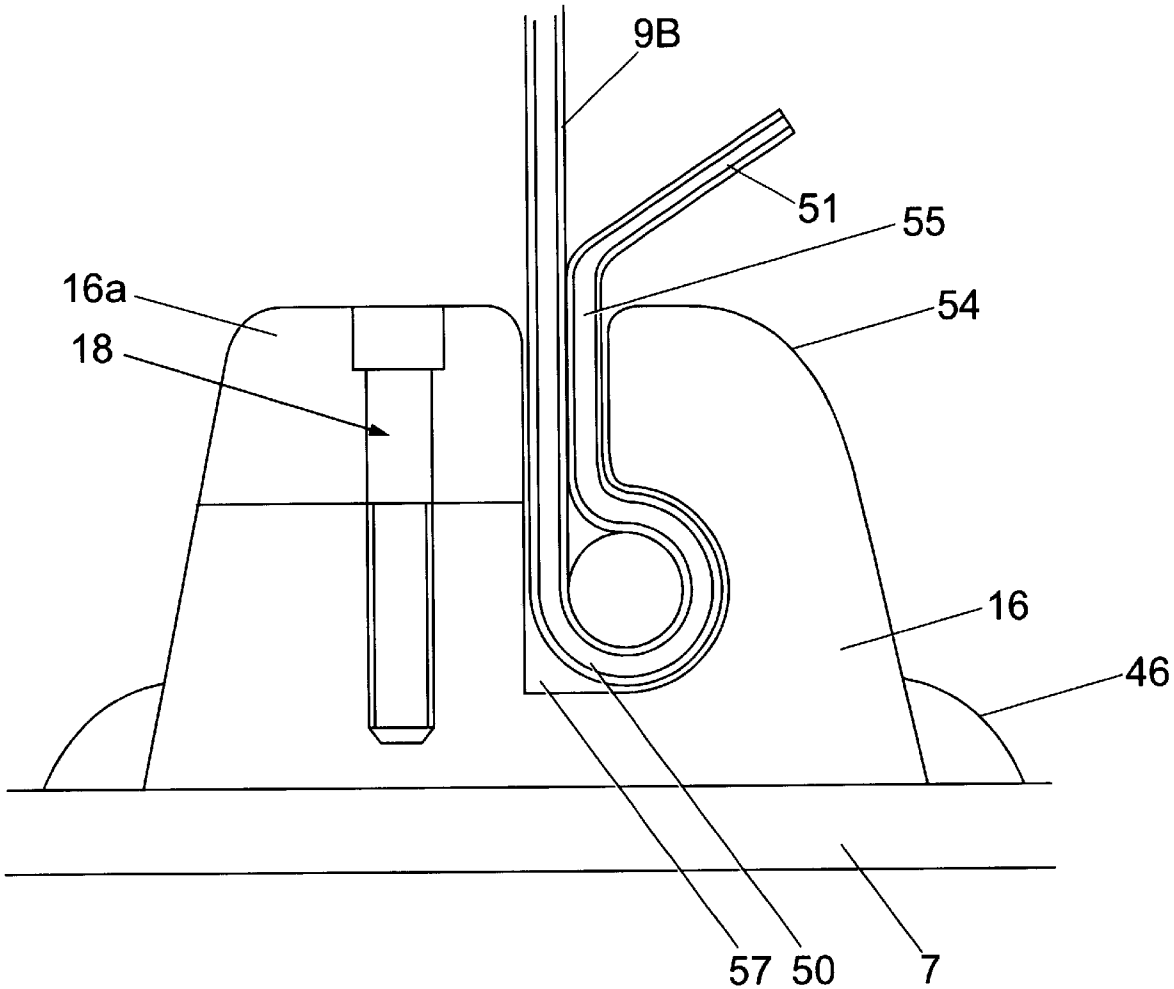
Figure 14:
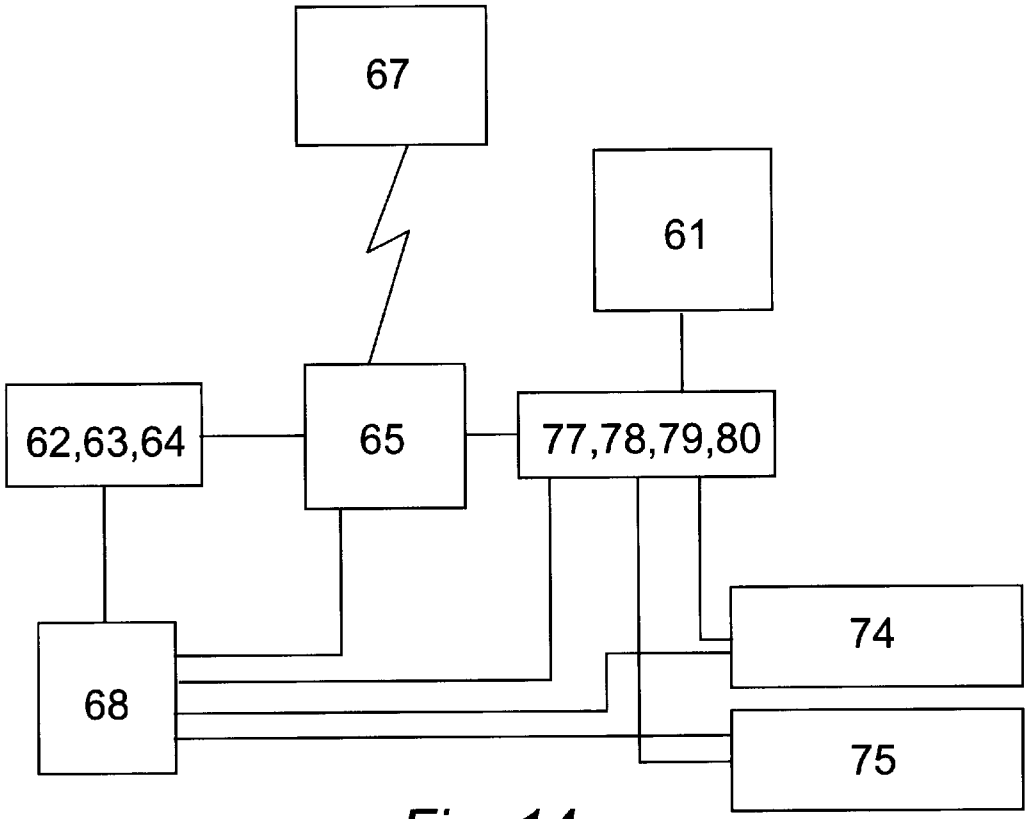
Figure 13:
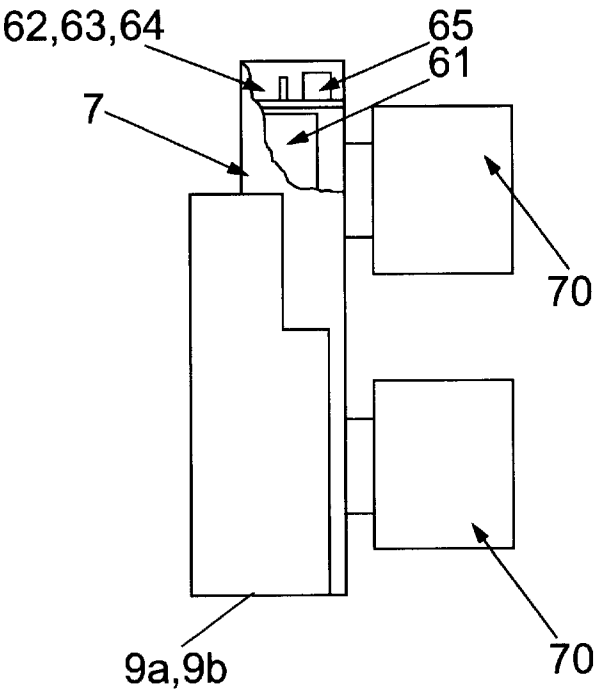
Figure 16:
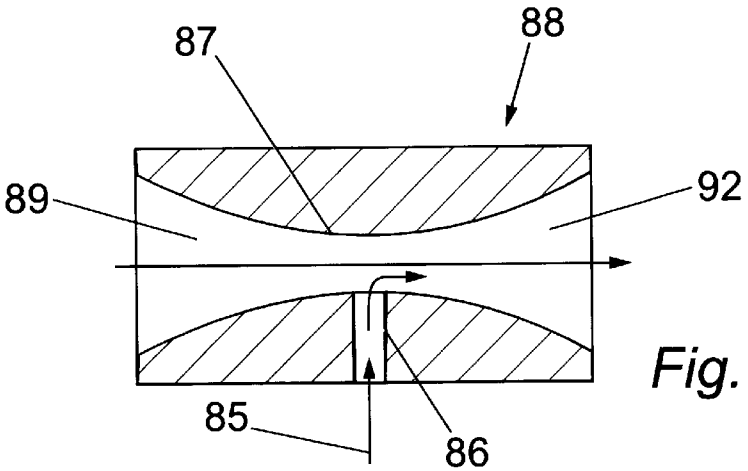
Figure 15:
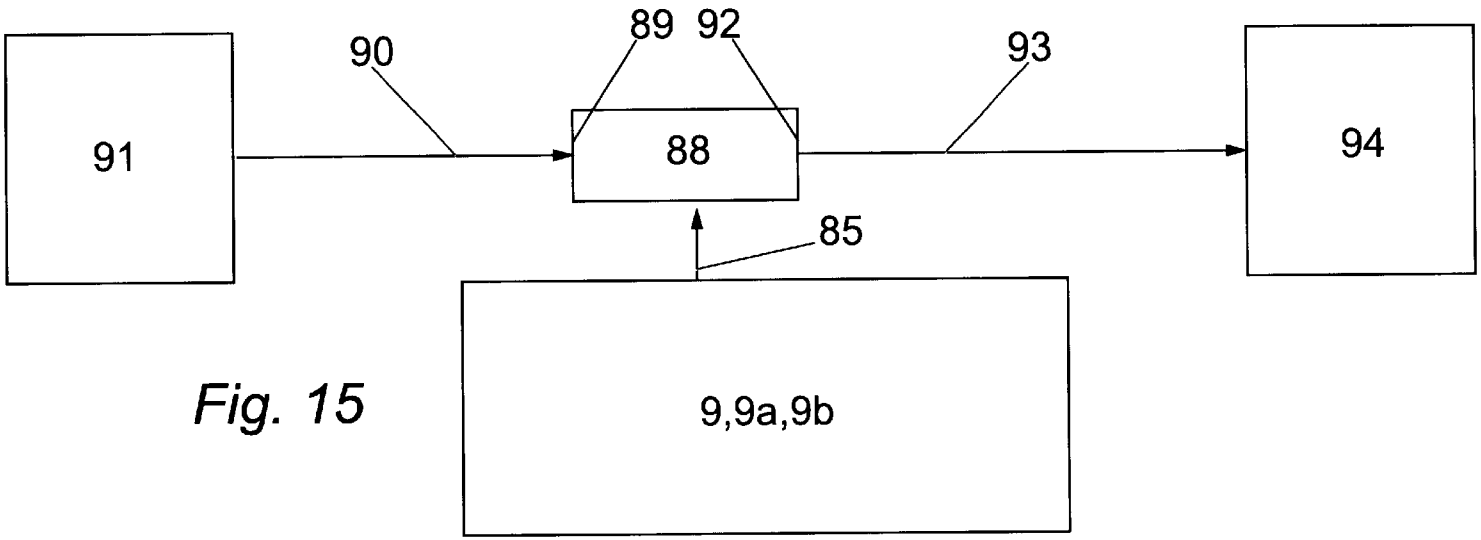
Figure 17:
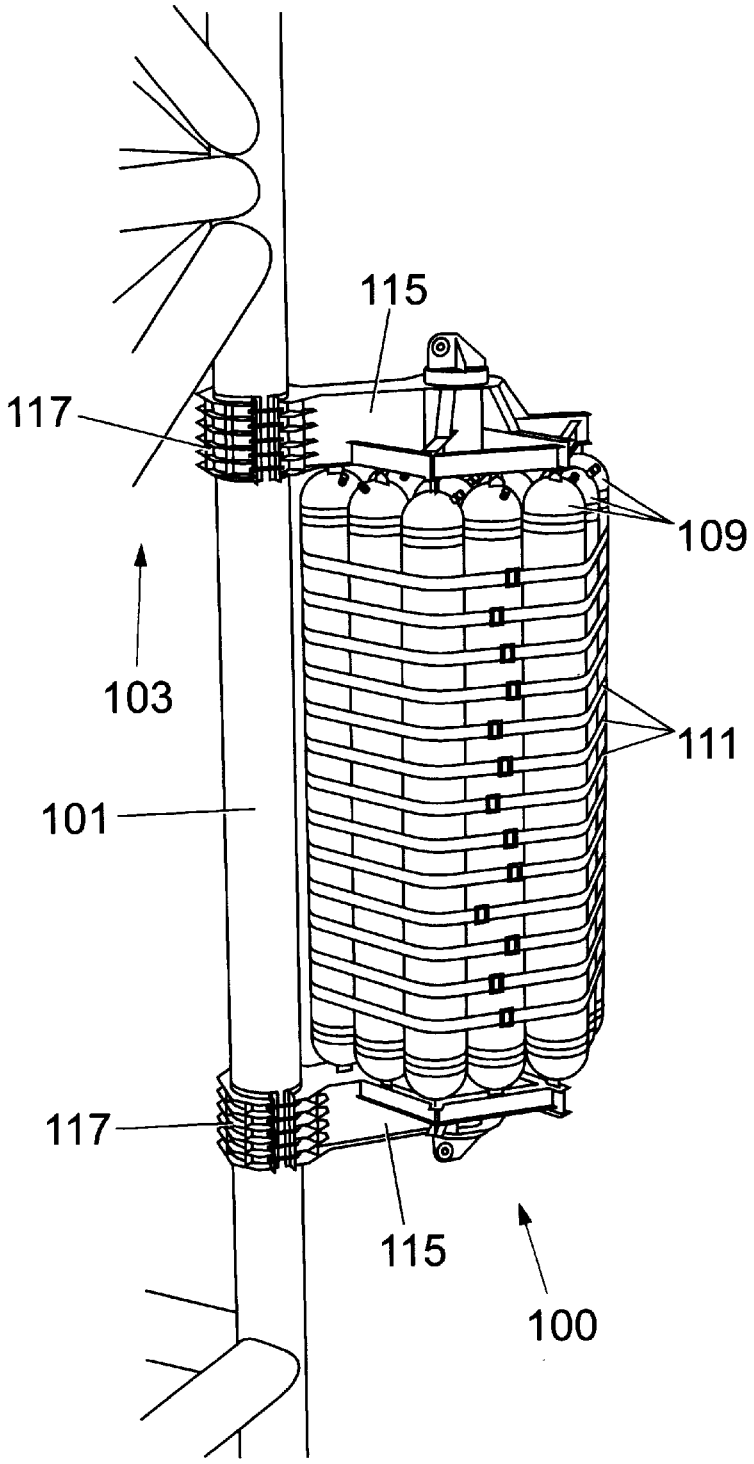
Figure 18:
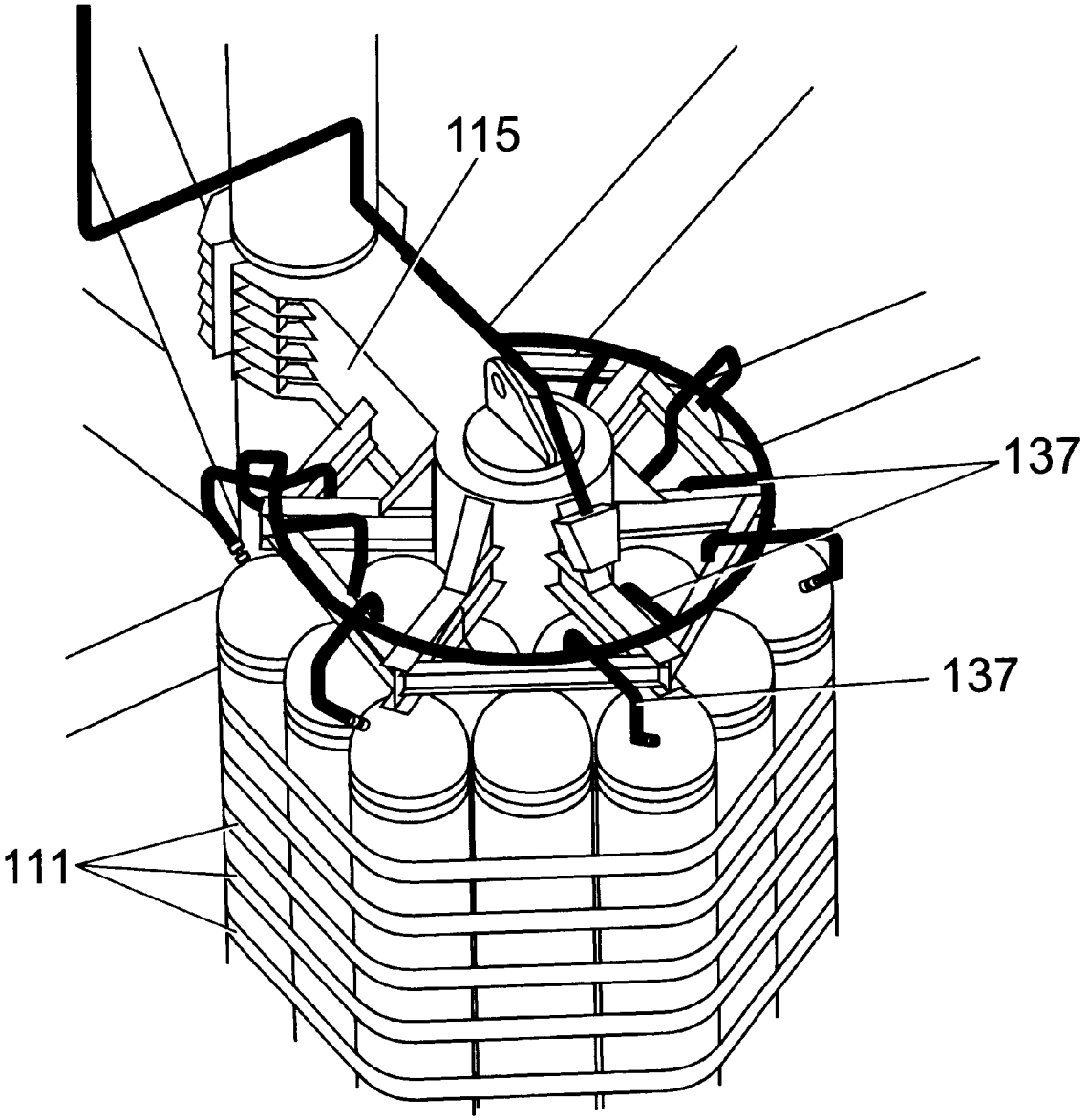
Figure 19:
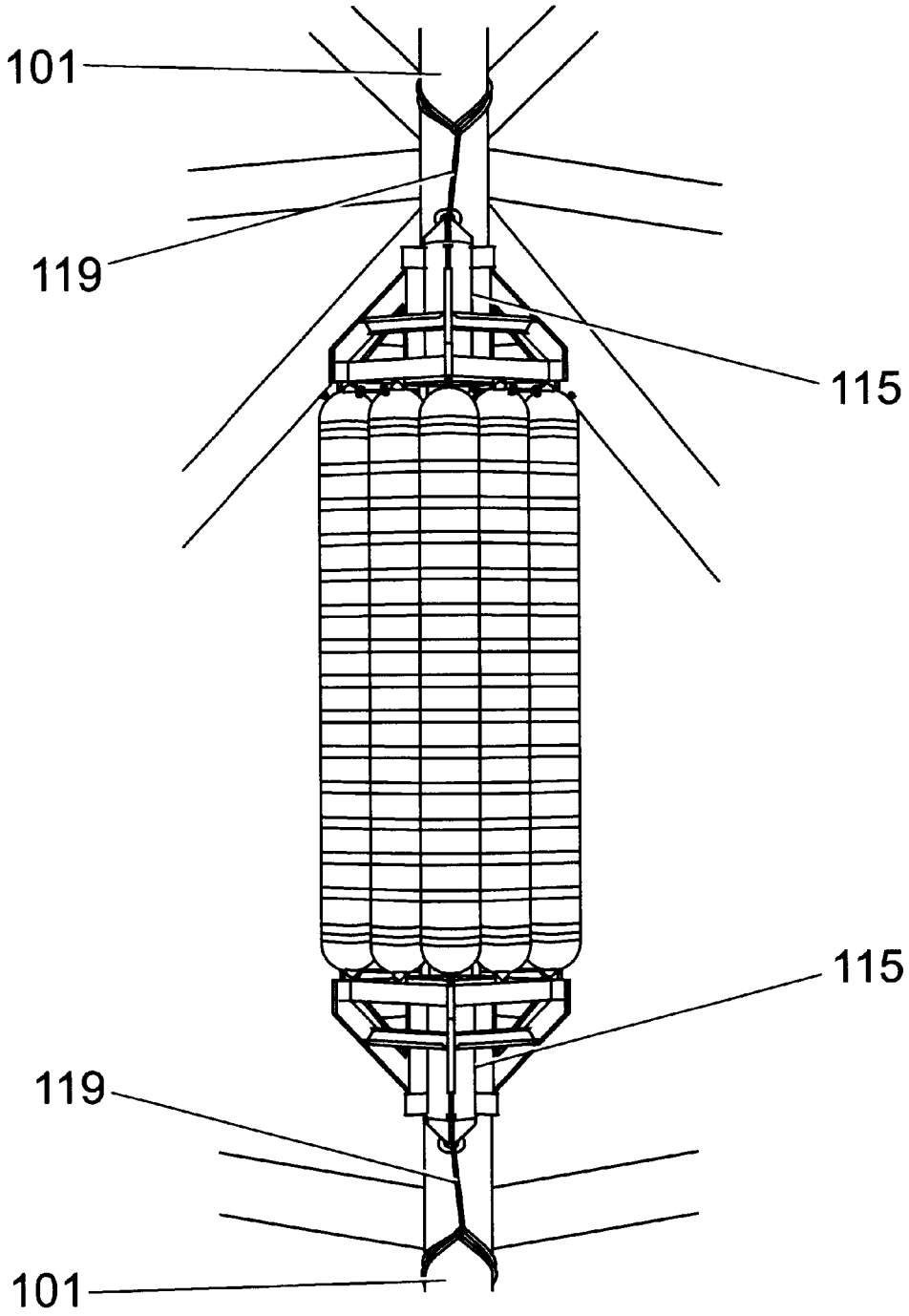
Figure 20:
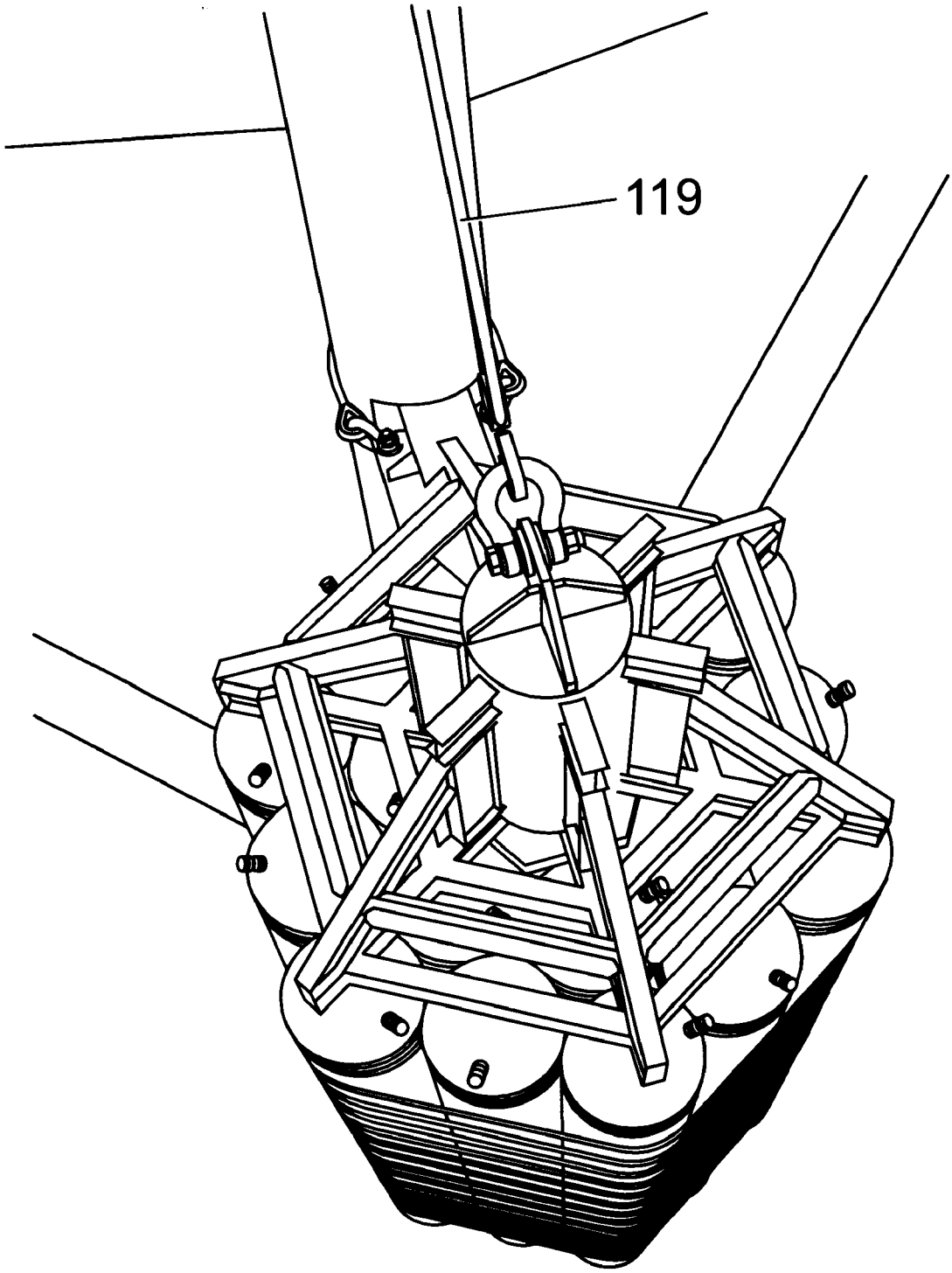
Figure 21:
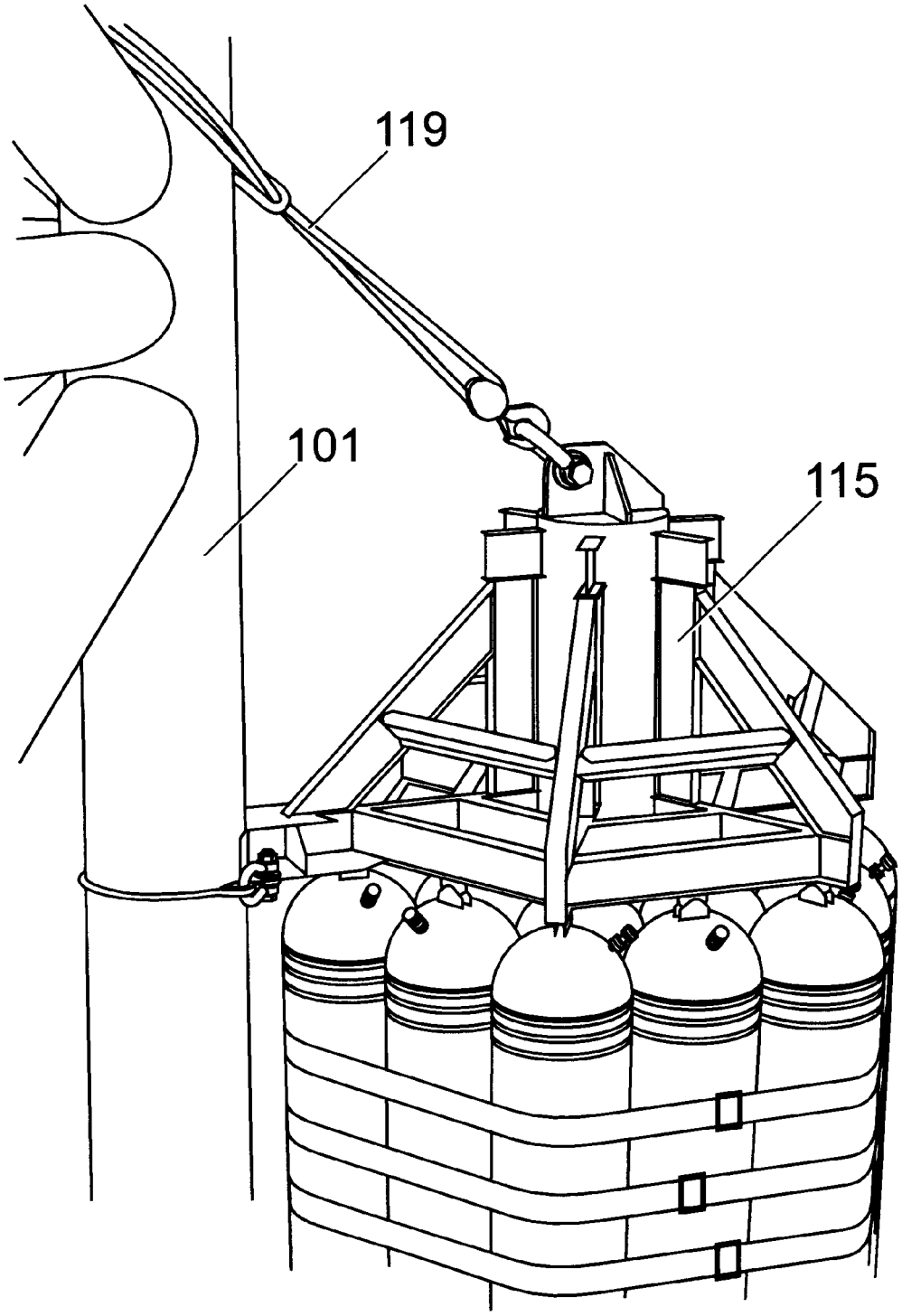
Figure 23:
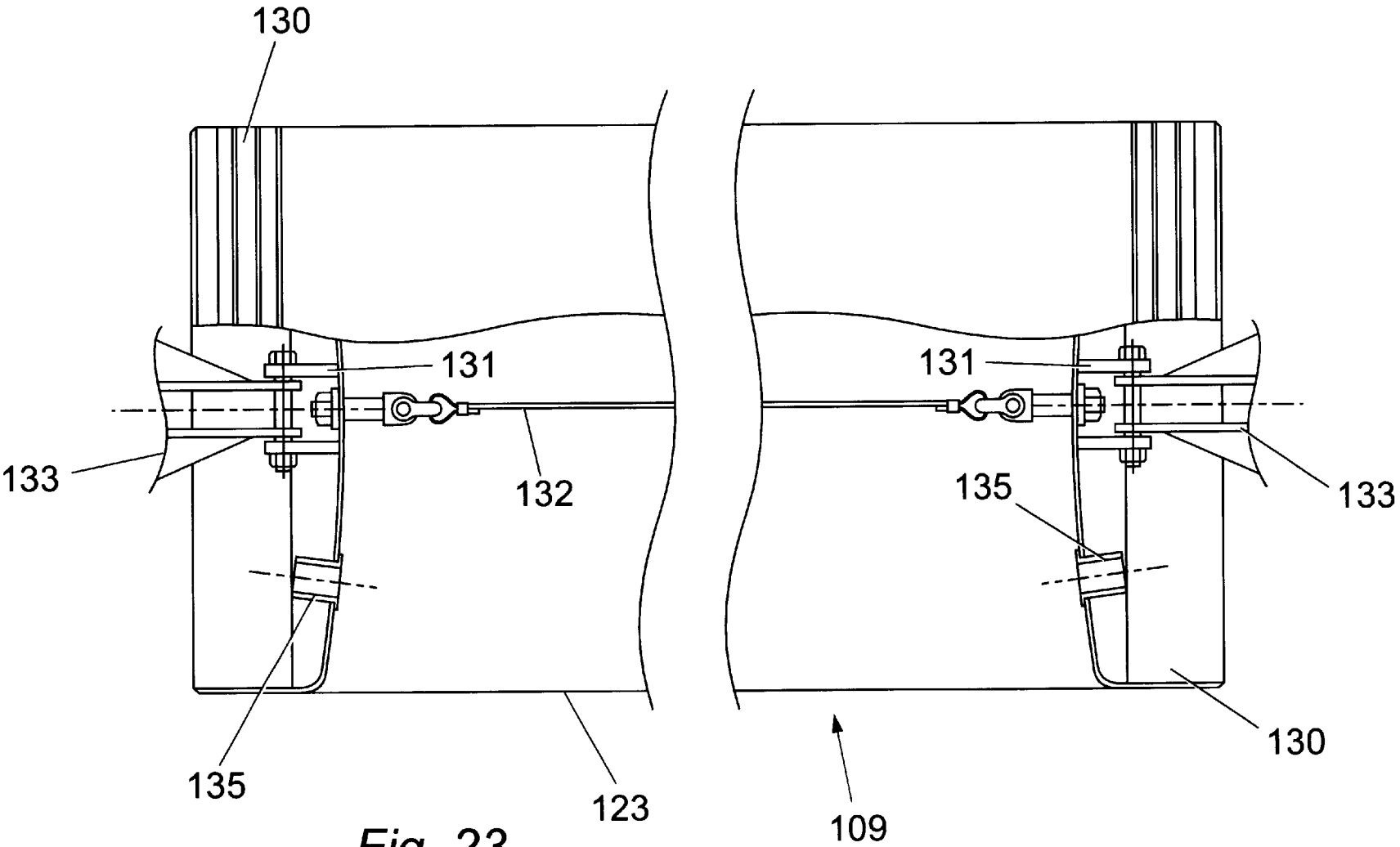
Figure 24:
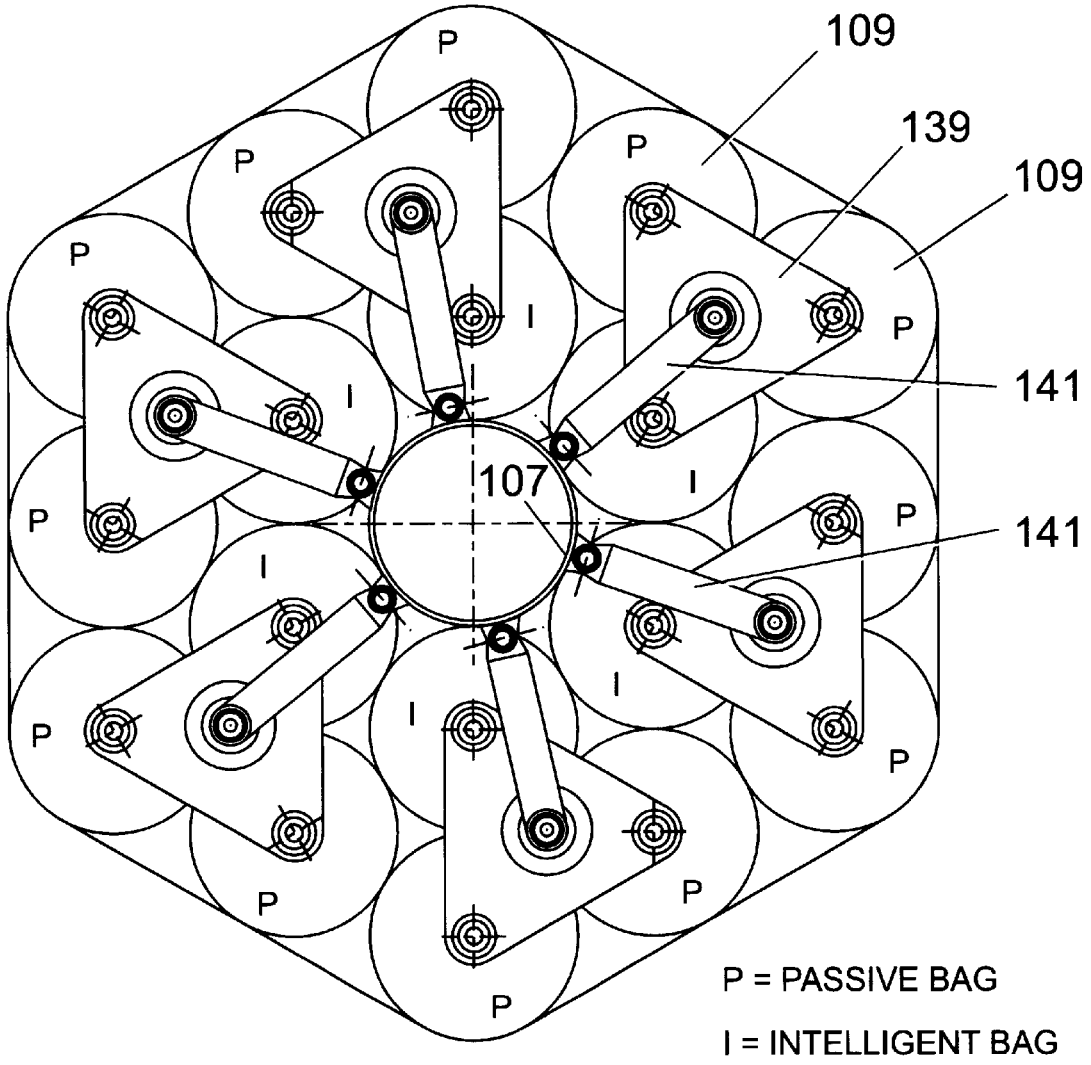
Figure 26:
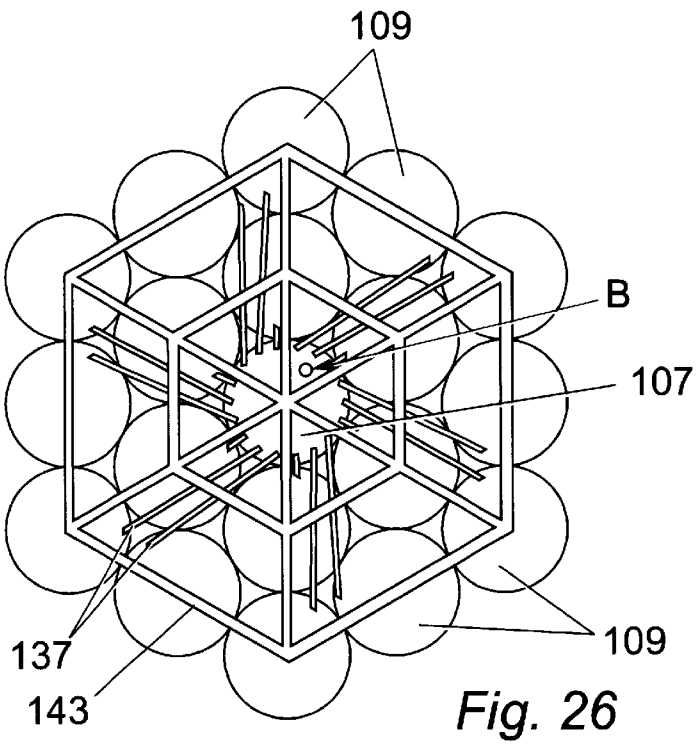
Figure 25:
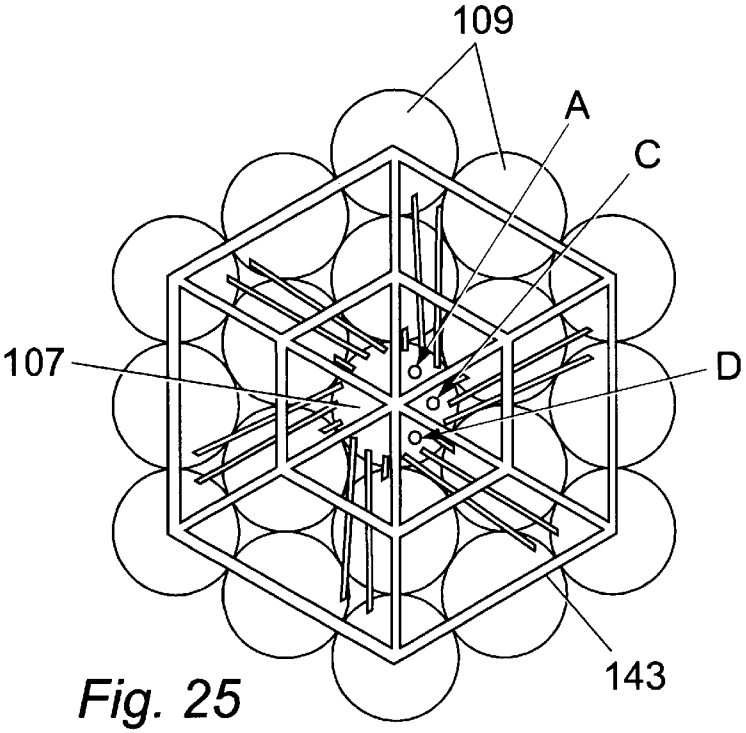
Figure 27:
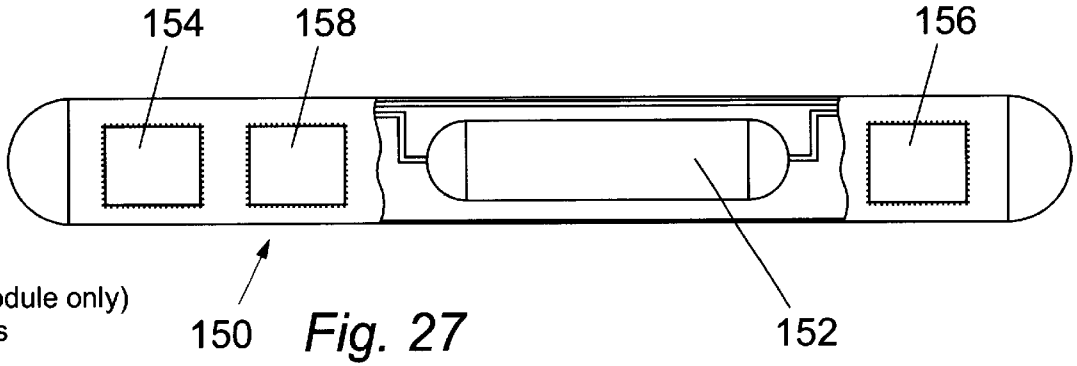

FIGS. 4(*a*), (*b*) and (*c*) are transverse cross sections of the lifting device of FIG. 1;

FIG. 5 is a longitudinal cross section of one of the inflatable bags of the lifting device of FIG. 1;

FIG. 6 is a transverse cross section of the inflatable bag of FIG. 5;

FIG. 7 is a perspective view of a number of uninflated lifting devices attached in a second arrangement to a drilling structure;

FIG. 8 is a perspective view of the lifting devices of FIG. 7 after inflation;

FIG. 9 is a perspective view of the drilling structure of FIG. 7 coupled to a tug boat;

FIG. 10 is a perspective view of the drilling structure of FIG. 7 being towed by a tug boat;

FIG. 11 is a cross-sectional view of a side base edge coupling device for a second embodiment of a buoyancy device in accordance with the invention;

FIG. 12 is a cross-sectional view of an end base edge coupling device for the buoyancy device of FIG. 11;

FIG. 13 shows a diagrammatical side view of the buoyancy device of FIG. 11;

FIG. 14 shows a schematic diagram of a buoyancy control system for controlling the buoyancy of the buoyancy device of FIG. 11;

FIG. 15 shows a schematic diagram of a deflation system for the buoyancy device of FIG. 11;

FIG. 16 shows a cross-sectional side view of a venturi fluid flow device shown in the schematic diagram of FIG. 15;

FIG. 17 is a perspective side view of a second embodiment of a buoyancy device in accordance with the present invention;

FIG. 18 is a perspective end view of the buoyancy device of FIG. 17;

FIG. 19 is a perspective side view of a third embodiment of a buoyancy device in accordance with the present invention;

FIG. 20 is a perspective end view of the buoyancy device of FIG. 19;

FIG. 21 is a second perspective end view of the buoyancy device of FIG. 19;

FIG. 22(*a*) is a part cross-sectional side view of a first embodiment of a buoyancy member utilised in the buoyancy device of FIGS. 17 and FIG. 19;

FIG. 22(*b*) is a cross-sectional side view of a portion of the buoyancy member of FIG. 22(*a*);

FIG. 23 is a part cross-sectional side view of a second embodiment of a buoyancy member utilised in the buoyancy device of FIGS. 17 and FIG. 19;

FIG. 24 is an end view of an alternative arrangement, to that shown in FIGS. 17 and 19, of coupling the buoyancy members to a tubular member;

FIG. 25 is a top view of the buoyancy device shown in FIGS. 17 and 19;

FIG. 26 is a bottom view of the buoyancy device shown in FIGS. 17 and 19; and FIG. 27 is a schematic view of a control system for a buoyancy member.

Figure 2:
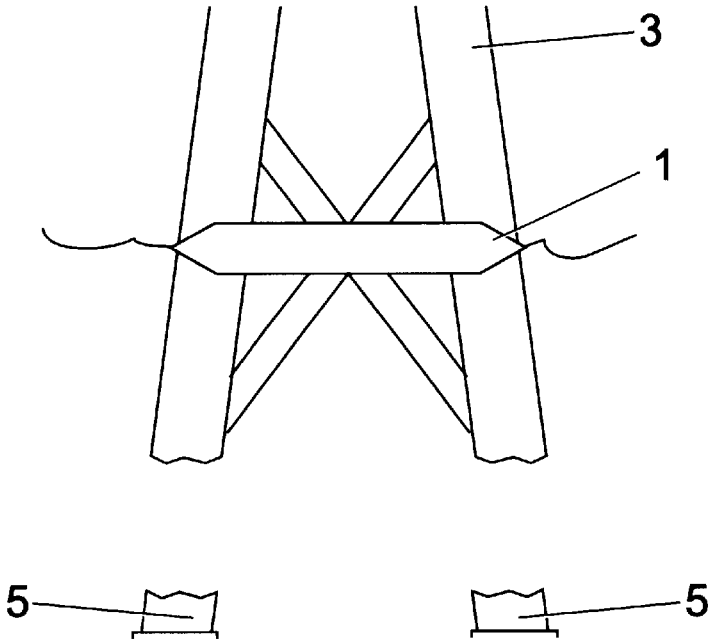
FIG. 2 is a perspective view of the lifting device of FIG. 1 after inflation.

FIG. 1 shows a first embodiment of a buoyancy device 1 attached in a horizontal position to an offshore drilling structure 3 requiring to be lifted up off the ocean floor and moved to a remote location. The buoyancy device of FIG. 1 is primarily a lifting device 1, such that when the legs 5 of the drilling structure 3 are cut and the lifting device 1 is inflated, the lifting device 1 raises the drilling structure 3 towards the water surface, as shown in FIG. 2.

Figure 3:
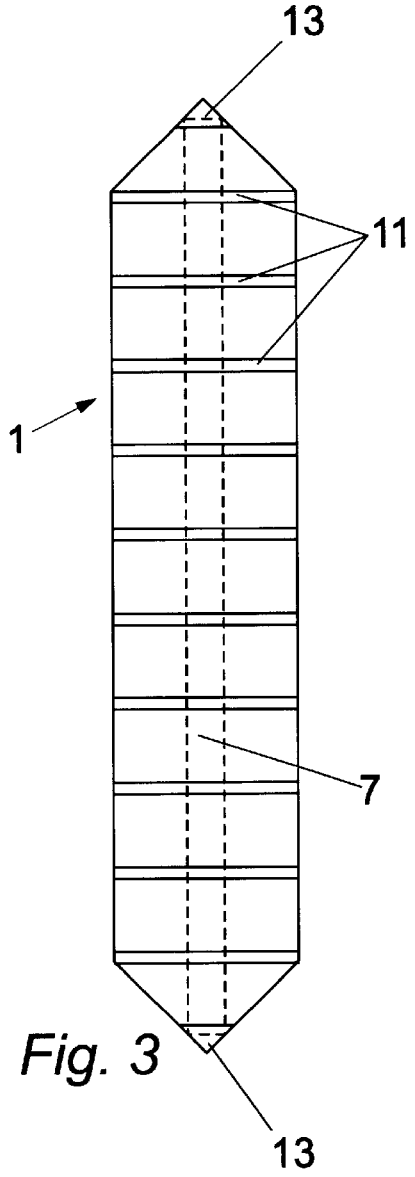
FIG. 3 is a side view of the lifting device of FIG. 1.

FIGS. 3, 4(*a*), 4(*b*) and 4(*c*) show the lifting device 1 in more detail. A tubular member 7 is located at the centre of the lifting device 1. Attached around the circumference of the tubular member 7 are individual inflatable bags 9 which run the length of the tubular member 7. The inflatable bags 9 are restrained on their outside surface by webbing straps 11 which strive to keep the inflatable bags 9 in the preferred wedge shape as shown in FIGS. 4(*a*), 4(*b*) and 4(*c*), as the inflatable bags 9 may naturally attempt to obtain a more rounded and less efficient shape.

Fixed at either or both ends of the tubular member 7 are towing points (not shown) to which one end of a towing cable 30 can be coupled. The other end of the towing cable 30 is coupled to a tug 32, therefore allowing the drilling structure 3 to be towed, as can be seen in FIGS. 9 and 10.

The inflatable bags 9 each comprise a middle section 8 and an end section 10, which are sealably coupled to the middle section 8, with an outer skin of the inflatable bags 9 defining an inner inflatable space. The longitudinal distance D of each end section 10 is four meters.

At either or both ends of the lifting device 1, is a cone 13, in which is provided an air pressure sensor system (not shown) of a suitable type known from the prior art.

Alternatively, the air pressure sensor system is located on board the tug 32.

The air pressure sensor system is connected to each inflatable bag 9, and in the embodiment shown in FIGS. 4(*a*), 4(*b*) and 4(*c*) there are nine inflatable bags 9.

Also located in the cone 13 is a manifold device (not shown) through which the individual bags 9 are inflated. The manifold is further connected to an air supply (not shown) on the tug boat 32 via an umbilical line (not shown).

Initially, the inflatable bags 9 are inflated via the manifold to the required pressure. If the pressure in one of the inflatable bags 9 drops, then the air pressure sensor system will inform an operator of the system that the pressure has dropped. If required, the air pressure can be increased via the manifold into the required inflatable bag 9.

If one of the inflatable bags 9 develops a leak such that the required air pressure cannot be maintained, as shown in FIG. 4(*b*), then the air supply via the manifold can be halted at the manifold.

As shown in FIG. 4(*c*), the remaining inflatable bags 9 expand by such an amount as to compensate for the failed bag. It is possible that extra air could be introduced into the remaining inflatable bags 9 to aid the compensation of the deflated bag.

For the embodiment with nine inflatable bags 9, the bags 9 are attached to the tubular member 7 every 40°, where each individual inflatable bag 9 is capable of increasing in width by 10°. Therefore, if one inflatable bag 9, as shown in FIGS. 4(*b*) and 4(*c*) were to become deflated and therefore inoperative then the remaining eight inflatable bags 9 would increase in width by 5°. As each inflatable bag 9 is capable of increasing in width by 10°, it is possible that two inflatable bags 9 could be deflated and that the seven remaining inflatable bags 9 would compensate.

FIG. 5 shows a cross-section along the length of an individual inflatable bag 9. There are attachment points 15 spaced along the length of the base of the inflatable bag 9 for attachment to the tubular member 7. The webbing straps 11 can also be seen which are spaced along the length of the outer surface of the inflatable bag 9.

FIG. 6 shows a cross-section across the breadth of the inflatable bag 9. The attachment point 15 is shown as a rivet 25 passing through a reinforced weld 27, at 1 meter intervals. The two sides 17, 19 of the inflatable bag 9 are formed from a medium weight fabric, and the outermost section 21 is formed from a heavy fabric for improved strength. The outermost section 21 is connected to the two sides 17, 19 by welds 23, which are offset to avoid chafing between adjoining inflatable bags 9. The radial distance A from the reinforced weld 27 to the innermost weld 23 is approximately 2 meters, and the radial distance B plus C from the innermost weld 23 to the outer circumference of the inflatable bag 9 is approximately 1.5 meters.

The overall length of the inflatable bags 9 is in the region of 27 meters, with attachment points 15 spaced at 1 meter intervals along the base of the inflatable bags 9. There are ten webbing straps 11 in all, which are 2 meters in length and are spaced at 2 meter intervals along the outermost section 21 of the inflatable bag 9. The radius of the inflatable bag structure is in the region of 3.5 meters, giving an inflated volume of the lifting device 1 in the region of 1000 $m^3$ . This provides a total lift in the region of 1000 tonne per lifting device 1.

However, the attachment points 15 may be provided by rings (not shown) spaced along the length of the tubular member 7 which engage with correspondingly sized holes (not shown) located on the inflatable bags 9.

The tubular member 7 may be constructed from a material having suitable strength and weight characteristics and may be constructed from steel. Alternatively, the tubular member 7 may be constructed from a suitably reinforced plastic material. If required, an inflatable bag 160 would be inserted and inflated within the tubular member 7 to aid the buoyancy of the tubular member 7.

The lifting device 1 may be connected to the drilling structure 3 by connection devices (not shown) located at each end of the tubular member 7. In addition, or alternatively, padeyes (not shown) may project out from the tubular member 7 for connection to the drilling structure 3.

FIG. 7 shows a second arrangement for lifting a drilling structure 3 off the ocean floor, and subsequently towing the drilling structure 3 to a remote location. A number of lifting devices 1, as previously described are attached to the drilling structure 3 at an angle approximately 45° to the horizontal plane of the ocean surface.

The lifting devices are inflated, and lift the drilling structure 3 off the ocean floor, such that the drilling structure 3 is lifted into a tilted towing position, as shown in FIG. 8, the angle of tilt being approximately 45° to the horizontal plane of the ocean surface. The tilted towing position provides a more stable towing position, and provides a greater depth clearance for the bottom of the drilling structure 3.

As shown in FIG. 9, a towing cable 30 is attached at one end to the drilling structure 3, and at the other end to a tug boat 32. FIG. 10 shows the tug boat 32 towing the drilling structure 3 towards land. A second embodiment of buoyancy device 2 is shown in FIGS. 11–16. The buoyancy device 2 of the second embodiment is similar to the lifting device 1 of the first embodiment, in that there are nine inflatable bags 9A, 9B (not all shown) attached around the circumference of a tubular member 7. The inflatable bags 9A, 9B are again restrained on their outside surface by a similar webbing strap arrangement.

However, the inflatable bags 9A, 9B are attached to the tubular member 7 in an arrangement that provide them with a cross-sectional shape having parallel side members 12 which are sealed at their top by a curved roof portion (not shown). The two parallel side members 12 of an inflatable bag 9A or 9B are coupled to the tubular member 7 in a spaced apart relationship, and provides the inflatable bag 9A, 9B with a cross-section which is substantially U-shaped. The two parallel side members 12, and the roof portion form a body section 12. This provides the advantage that access to the inner space of the inflatable bag 9A or 9B, as defined by the outer skin of the inflatable bag 9A, 9B, can be gained through the side wall of the tubular member 7.

A coupling device 14 for coupling the parallel side members 12 to the tubular member 7 is shown in FIG. 11. The coupling device 14 comprises an inflatable member base edge securing rail 40 which is welded to the tubular member 7 by welding 46. The securing rail 40 may be formed from a suitable metallic material such as steel or aluminium, and its lower face 47 is curved to correspond to the curvature of the tubular member 7. The securing rail 40 has a T-shaped recess 48 running along its entire length. The base 50 of the parallel side member 12 is formed by folding the edge 51 of the parallel side member 12 around a rope filler 42, and welding the flap 51 to the parallel side member 12. The flap 51 is welded to the parallel side member 12 by high frequency ultrasonic welding 52, and the rope filler is formed from a suitable material, which is typically plastic. An example of the inflatable bag 9A, 9B fabric is PVC coated woven polyester fabric.

The base 50 is thus formed to have a shoulder 53 which co-operates with one side of the T-shaped recess 48.

The base 50 of one of the inflatable bags 9A is inserted into one end of the coupling device 14, and pulled along the entire length of the T-shaped recess 48, so that the entire length of the base 50 is located within the T-shaped recess 48. Then, the base 50 of the other inflatable bag 9B is inserted into one end of the coupling device 14 and also run along the entire length of the T-shaped recess 48 so that the entire length of the base 50 of the inflatable bag 9B is located within the T-shaped recess 48. Thus, with the two parallel side members 12 of the inflatable bags 9A and 9B in a back-to-back relationship, the bases 50 are retained within the T-shaped recess 48 by their respective shoulders 53.

Alternatively, both bases 50 of the inflatable bags 9A and 9B may be run into the T-shaped recess 48 at the same time.

Each inflatable member 9A, 9B also has two parallel end members 55 which are sealably coupled to the roof portion and the two parallel side members 12, and form end sections 55 which seal the ends of the inflatable members 9A, 9B. The two parallel end members 55 have a base 50, which is similar in construction to the base 50 of the parallel side members 12. The base 50 of one of the parallel end members 55 is shown in FIG. 12, and is secured to the tubular member 7 by a second coupling device 16. The second coupling device 16 has an L-shaped recess 57 into which the base 50 of the parallel end member 55 is secured. However, in order to locate the base 50 into the L-shaped recess 57, a portion 16A of the second coupling device 16 is removed from the coupling device 16. The base 50 can then be inserted into the L-shaped recess 57, and when properly located, the removable portion 16A is then re-attached by means of a retaining bolt 18.

In order to provide a further sealing capability to the inflatable bags 9A, 9B when the pressure within the inflatable bags 9A, 9B is increased the flap 51 will naturally fit around the curved upper face 54 of the first and second coupling devices 14, 16.

FIGS. 13 and 14 show the control system for providing a controlled variable buoyancy to the second buoyancy device 2. Located within the tubular member 7 is an air reservoir 61 which can either be self-contained or can also be connected to a surface air reservoir (not shown) via an umbilical air supply (not shown) by conventional means which are well known in the prior art. Also mounted within the tubular member 7 are pressure 62, displacement 63 and acceleration 64 transducers which together form a transducer array. The pressure transducer 62 typically comprises a diaphragm (not shown) which has a strain gauge (not shown) attached thereto, one side of the diaphragm having a sealed known pressure acting on that side of the diaphragm, and the other side of the diaphragm being open to the ambient pressure of the outside water. An example of a suitable pressure transducer is a DIGIQUARTZ(™) pressure transducer 62. An example of a suitable displacement transducer is a SIMRAD(™) acoustic tracking system. An example of a suitable acceleration transducer 64 is well known in the art as an accelerometer. Also located within the tubular member 7 is an acoustic transponder 65 which allows a computer control system 67 mounted on a surface ship to communicate with the control system located within the tubular member 7. An example of a suitable acoustic transponder 65 is an acoustic telemetry system such as a SIMRAD HPR 4000 (™) system. Alternatively, the computer control system 67 can communicate with the control system mounted within the tubular member 7 by means of a hardwire electrical cable (not shown) being connected between the tubular member 7 and the surface ship, whereby the signals to be communicated are multiplexed across the electrical cable, by conventional means well known in the art.

Alternatively, a computer control system 67 may be mounted within the tubular member 7.

The computer control system 67 allows the movement plan of the buoyancy device 2 to be pre-programmed, such that signals from the transducer array 62, 63, 64 are transmitted to the computer control system 67 which monitors the movement of the buoyancy device 2 and can send signals back to the control system to vary the buoyancy of the buoyancy device 2 as necessary.

Power is supplied to the buoyancy device 2 via a power unit 68 which is either located within the tubular member 7 in the form of a battery unit, or is located on a surface ship, and in the latter case the power is supplied from the power unit 68 to the tubular member 7 via an umbilical electrical cable (not shown).

Each of the inflatable bags 9 has an airflow inlet (shown as 95*a* in FIG. 11) and an airflow outlet (shown in 95*b* in FIG. 11) mounted within the side wall of the tubular member 7 at a location that allows access to the inflatable bags 9A, 9B between the spaced apart parallel side members 12 and the parallel end members 55. Air is supplied into each inflatable bag 9A, 9B by two discrete mechanisms from the air reservoir 61. The first mechanism is an automatic regulation 77 of the inflatable bag 9 through a pressure relief valve mechanism (not shown) which regulates the flow of air supplied from the air reservoir 61, since the air reservoir 61 will be at a relatively high pressure with respect to the inflatable bag 9A, 9B. Also, by using this automatic regulation mechanism 77, a constant flow through of air into the inflatable bag 9A, 9B is maintained in order to compensate for air leakage from the inflatable bags 9A, 9B due to imperfections in the control system and the inflatable bag 9A, 9B structure. Secondly, there is an applied regulation mechanism 78 which operates by means of a control valve system (not shown) which regulates the pressure in each individual bag 9 in accordance with the calculated movement plan held within the computer control system 67. The pressure relief valve mechanism, and the control valve system, which together form an inflatable bag 9A, 9B inflation system 74, are connected in parallel between the air reservoir and the inflatable bag 9 air inlet by appropriate air supply conduits (not shown).

The air flow outlet of the inflatable bag 9 is connected to a second pressure relief valve mechanism (not shown) to provide an automatic venting mechanism 79 of the inflatable bag 9A, 9B if, in particular when the buoyancy device 2, attached to the structure to be lifted, is raised through the water. This is required because as the buoyancy device 2 is raised, the surrounding ambient water pressure will reduce, but the air pressure within the inflatable bags 9A, 9B will remain the same. Therefore, this automatic venting mechanism 77 allows the buoyancy device 2 to be raised slowly without damage to the inflatable bags 9A, 9B. However, if the automatic venting mechanism 79 through the second pressure relief valve mechanism is not sufficient, then a second control valve system connected to the air outlet of the inflatable bag 9A, 9B provides an applied venting mechanism 80 to vent a greater amount of air. The second pressure relief valve mechanism and the second control valve system together form an inflatable bag 9A, 9B deflation system 75.

Each inflatable bag 9A, 9B is provided with an individual control system such that the distribution of air flow input and output from the inflatable bags 9A, 9B is controlled individually such that each inflatable bag 9A, 9B is a discreet subsystem of the overall buoyancy device 2.

The control system for the inflatable bag 9A, 9B is a closed loop feedback system, in which the pressure 62, displacement 63 and acceleration 64 transducers continually measure the pressure being applied to, and the speed and acceleration of the buoyancy device 2. Also measured is the pressure within each inflatable bag 9A, 9B by means of a pressure sensor (not shown) located within each bag 9A, 9B. These measured quantities are then compared to a predetermined movement plan held within the computer control system 67 and corrections to the actual movement path of the buoyancy device 2 can then be made by controlled operation of the first and second control valve systems.

FIG. 14 schematically shows the automatic 77 and applied 78 regulation mechanisms, and the automatic 79 and applied 80 venting mechanisms controlling the air flow into the air flow inlet and being vented from the air flow outlet.

In addition to the abovementioned buoyancy control mechanism, additional buoyancy control measures can be used. For example, a "bursting disc" may be incorporated into the outer skin of the inflatable bag 9A, 9B, the bursting disc comprising a metallic disc which will burst when the differential pressure across the metallic disc face reaches a predetermined level. An example of a bursting disc is a SWAGELOCK(™) bursting disc. Also, by attaching a balance chain, which is well known in the art, the balanced equilibrium of the buoyancy device 2 will be reached at a certain ascent height. Also, a venturi suction system for rapid inflatable bag 9A, 9B, venting could also be utilised in the buoyancy device 2 and such a system is shown in FIGS. 15 and 16.

In FIGS. 15 and 16, a second air flow outlet 85 is provided from the inflatable bag 9A, 9B which leads by a conduit (not shown) to a tapping 86 in the throat restriction 87 of a venturi device 88. The venturi inlet 89 is connected by a conduit 90 to a relatively high pressure air reservoir 91, which may be for instance the air reservoir 61 mounted within the tubular member 7 or mounted at the sea surface. The venturi outlet 92 is connected by another conduit 93 to a relatively low pressure reservoir 94 which may be the ambient pressure of the surrounding water. Therefore, if rapid inflatable bag 9A, 9B venting is required, air is pumped from the relatively high pressure reservoir 91 through the venturi device 88 and into the relatively low pressure reservoir 94, thereby creating a vacuum in the inflatable bag 9A, 9B. The use of the venturi device 88 is initiated according to the control system instructions.

In order to reduce the number of components in the buoyancy device 2, distinct types of inflatable bags 9 may be provided. The buoyancy device 2 may be provided with a combination of the following distinct types of inflatable bags 9. "Dumb" inflatable bags are provided with the abovementioned automatic regulation mechanism 77 and the abovementioned applied regulation mechanism 78, but are only provided with the abovementioned automatic venting mechanism 79, which obviates the requirement for a relatively expensive applied venting mechanism 80. Secondly, "intelligent" inflatable bags 9A, 9B have the abovementioned automatic 77 and applied 78 regulation mechanisms and the automatic 79 and applied 80 venting mechanisms. This provides the advantage that a number of "dumb" inflatable bags can be provided in combination with a number of "intelligent" inflatable bags 9A, 9B, thereby obviating the expense of a number of applied venting mechanisms 80. Further, a number of contingency redundant inflatable bags can be provided which have the characteristics of the "intelligent" inflatable bags but are normally redundant, these inflatable bags only operating in the event of compromise to the other inflatable bags 9A, 9B.

FIG. 17 shows a second embodiment of a buoyancy device 100 attached in a vertical orientation to a leg 101 of an offshore drilling structure 103 requiring to be lifted up off the ocean floor and moved to a remote location. The buoyancy device 100 of FIG. 17 is primarily a lifting and/or towing device 100, such that when the legs 101 of the drilling structure 103 are cut and the lifting device 100 is inflated, the lifting device 100 raises the drilling structure 103 towards the water surface.

FIGS. 24, 25 and 26 show the lifting device 100 in more detail. A tubular member 107 is located at the centre of the lifting device 100. Arranged around the circumference of the tubular member 107 are individual bags 109, which are preferably inflatable, and which run the length of the tubular member 107. However, it may be that a tubular member 107 is not required, and thus the presence of the tubular member 107 is optional. The inflatable bags 109 are restrained on their outside surface by webbing straps 111 which strive to keep the inflatable bags 109 in the preferred array arrangement shown in FIGS. 17 to 21 and 24 to 26.

Arranged at both ends of the lifting device 100 are end portions 115 to which each of the bags 109 is attached, where the end portions 115 are coupled to the leg 101. FIGS. 17 and 18 show the lifting device 100 being secured to the leg 101 by means of clamping devices 117 which are integral with the end portions 115. The clamping devices 117 can either be formed in a hinge at one side, and screw bolts at the other side, or can be formed in two half shells which are bolted together to form the clamping device 117, or can be formed in any other suitable way. FIGS. 19 to 21 show the lifting device 100 being secured to the leg 101 by means of wires 119 which are tethered to suitable points on the legs 101 and are also secured to the end portions 115.

Figures 22A, 22B:
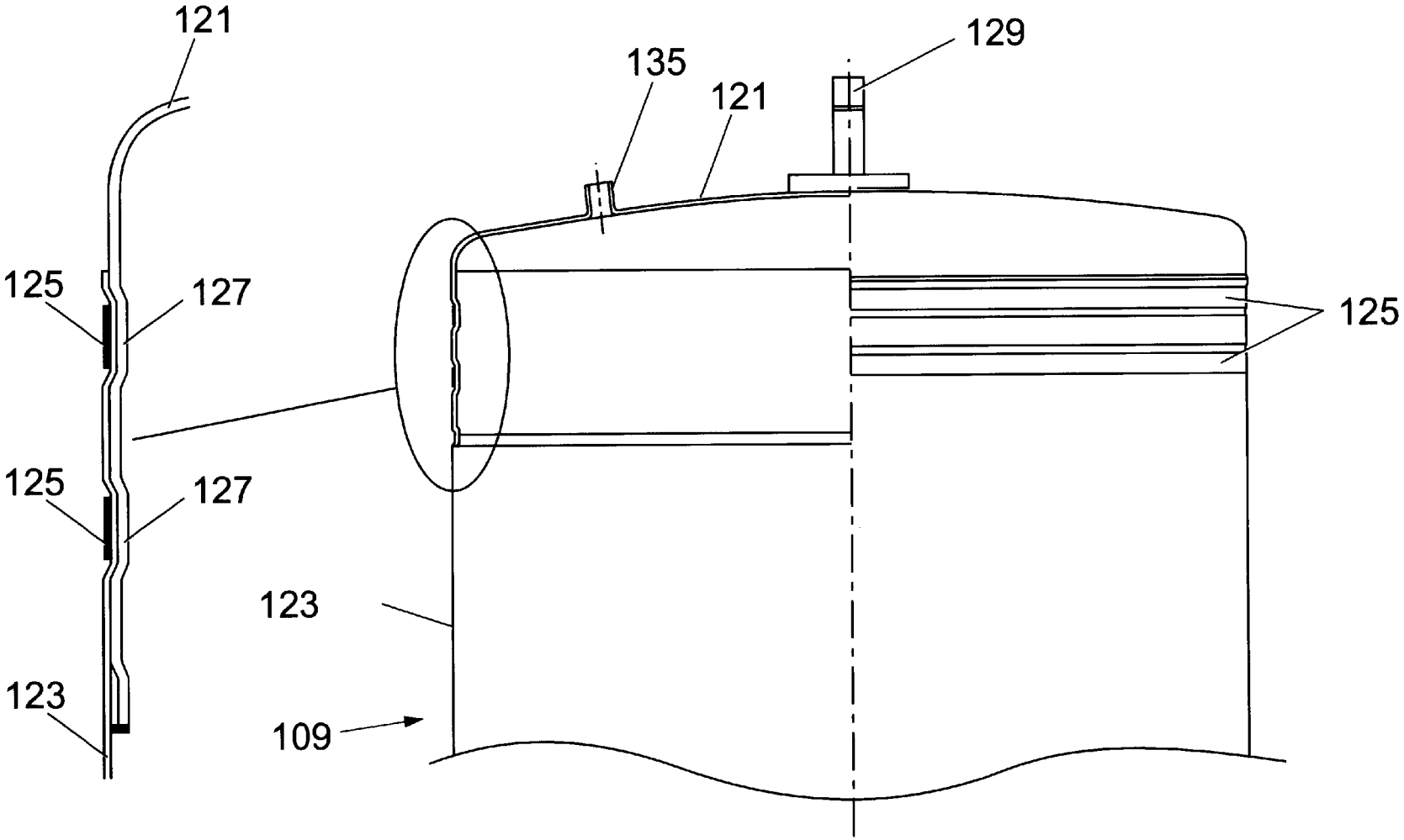

FIG. 22*a* shows the first embodiment of a bag 109, where the bag 109 comprises two end members 121 which are in the form of a dome or dish 121, and a bag portion 123 which is formed from a suitable flexible material which is preferably a woven polyester, polypropylene or nylon, or other suitable impervious material. The dishes 121 are arranged at either end of the bag 109, and the bag portion 123 extends between the end members 121. The dish 121 is shown in FIG. 22*a* as having its convex surface pointing outwardly of the bag 109. The bag portion 123 is coupled to the outer surface of the respective dish 121 by means of retaining bands or straps 125 which are tightened around the overlapping section of the bag member 109 such that the straps 125 locate in grooves 127 formed in the outer surface of the dish 121. The straps 125 are tightened such that the interior of the bag member 109 is substantially watertight with respect to the exterior of the bag member 109. A support pin 129 is provided on the outer surface of the dish 121 for engagement with the framework of the end portion 115.

FIG. 23 shows a third embodiment of bag member 109, where two dishes 130 are provided at the ends of a similar bag portion 123. However, in this embodiment, the dishes 130 are arranged such that their convex ends point inwardly of the bag member 109. Also, a padeye 131 is provided on the inwardly pointing end of the dish 130, and a strainer cable or strap 132 extends between the two respective padeyes 121. This provides the advantage that when the bag member 109 is fully inflated, the cable 132 resists outward movement of the respective dishes 130. The dishes 130 are provided with support arms 133 on their outer surface for coupling to the frame of the end portions 115.

Service penetrators 135 are provided in the dishes 121, 130 to permit air to be blown into, or withdrawn from, the bag members 109. As shown in FIG. 18, an arrangement of tubes 137 are coupled to the service penetrators 135 and are further coupled to an air supply (not shown).

As shown in FIG. 24, an array of six inner bags 109, and twelve outer bags 109 is provided, where one inner bag 109 may be coupled to two outer bags 109 by means of a triplate 139 which is secured to the support pin 129 or support arm 133 as required. The triplates 139 are further movably coupled to a tubular member 107 via a hinged arm 141, where the hinged arms 141 are equispaced around the end of the circumference of the tubular member 107. Accordingly, the triplates 139 and hinged arms 141 form end portions 115.

Alternatively, and as shown in FIGS. 25 and 26, the support pins 129, or support arms 133, are fixed directly to the frame 143 of the end portions 115.

The embodiments described above have the advantage that the end units 115 can be re-used for another lift, and the length of the bag members 123, and cable 132 if present, can be varied to suit a specific lift.

One end of a towing cable (not shown) can be coupled to one or more end portions 115, and the other end of the towing cable is coupled to a tug (not shown), therefore allowing the drilling structure 103 to be towed.

An air supply system 150 is shown in FIG. 27 and is preferably located within the tubular member 107. The air supply system 150 includes an air bottle 152 which initially stores the air which is blown into the bag members 109. The air bottle 152 is coupled to controlled valves provided for one, more than one, or all of the bag members 109, such that via access to inlet 154 and outlet 156 air valves, the level of buoyancy of the individual bag members 109, and thus the lifting device 100 can be controlled. The air supply system 150 is also provided with an access point 158 which provides access to alternation terminal boards, for one, more than one or all of the bag members 109.

In a particularly preferred embodiment, the lifting device 100 can be arranged such that the outer twelve bag members 109 are "passive" bags in that their relative buoyancy is only variable by manual control. However, the inner six bag members 109 are "intelligent" bags in that their relative buoyancy can be altered automatically by the air supply system 150, which is provided with an arrangement of sensors which will now be described.

The tubular member 107 may be constructed from a material having suitable strength and weight characteristics and may be constructed from steel. Alternatively, the tubular member 107 may be constructed from a suitably reinforced plastic material. The dishes 121, 130 are preferably formed from fibreglass, plastic or a metal such as steel or aluminium.

A number of lifting devices 100, as previously described, could be attached to the drilling structure 103 at an angle of approximately 45° to the horizontal plane of the ocean surface, or alternatively could be attached either vertically or horizontally with respect to the horizontal plane of the ocean surface.

The lifting devices 100 are inflated, and lift the drilling structure 103 off the ocean floor, such that the drilling structure 103 is lifted into a tilted towing position, such that the angle of tilt is preferably approximately 45° to the horizontal plane of the ocean surface. The tilted towing position provides a more stable towing position, and provides a greater depth clearance for the bottom of the drilling structure 103.

The air bottle 152 can be supplemented with air by it being connected to a surface air reservoir (not shown) via an umbilical air supply (not shown) by conventional means which are well known in the prior art. Also mounted within the tubular member 107 may be an arrangement of air pressure sensors, displacement and acceleration transducers which together form a transducer array. The pressure transducer typically comprises a diaphragm (not shown) which has a strain gauge (not shown) attached thereto, one side of the diaphragm having a sealed known pressure acting on that side of the diaphragm, and the other side of the diaphragm being open to the ambient pressure of the outside water. An example of a suitable pressure transducer is a DIGIQUARTZ(™) pressure transducer. An example of a suitable displacement transducer is a SIMRAD(™) acoustic tracking system. An example of a suitable acceleration transducer is well known in the art as an accelerometer. Also located within the tubular member 107 may be an acoustic transponder which allows a computer control system mounted on a surface ship to communicate with the control system located within the tubular member 107. An example of a suitable acoustic transponder is an acoustic telemetry system such as a SIMRAD HPR 4000 (™) system. Alternatively, the computer control system can communicate with the control system mounted within the tubular member 107 by means of a hardwire electrical cable (not shown) being connected between the tubular member 107 and the surface ship, whereby the signals to be communicated are multiplexed across the electrical cable, by conventional means well known in the art.

Alternatively, a computer control system may be mounted within the tubular member 107.

The computer control system allows the movement plan of the buoyancy device 100 to be pre-programmed, such that signals from the transducer array are transmitted to the computer control system which monitors the movement of the buoyancy device 100 and can send signals back to the control system to vary the buoyancy of the buoyancy device 100 as necessary.

Power is supplied to the buoyancy device 100 via a power unit which is either located within the tubular member 107 in the form of a battery unit, or is located on a surface ship, and in the latter case the power is supplied from the power unit to the tubular member 107 via an umbilical electrical cable (not shown).

Air is supplied into each inflatable bag 109 preferably by two discrete mechanisms from the air bottle 152. The first mechanism is an automatic regulation of the inflatable bag 109 through a pressure relief valve mechanism (not shown) which regulates the flow of air supplied from the air bottle 152, since the air bottle 152 will be at a relatively high pressure with respect to the inflatable bag 109. Also, by using this automatic regulation mechanism, a constant flow through of air into the inflatable bag 109 can be maintained, if required, in order to compensate for air leakage from the inflatable bags 109 due to imperfections in the control system and the inflatable bag structure 109. Secondly, there may be an applied regulation mechanism which operates by means of a control valve system (not shown) which regulates the pressure in each individual bag 109 in accordance with the calculated movement plan held within the computer control system. The pressure relief valve mechanism, and the control valve system, which together form an inflatable bag 109 inflation system, are connected in parallel between the air bottle 152 and the inflatable bag 109 air inlet by appropriate air supply conduits (not shown).

The air flow outlet of the inflatable bag 109 is connected to a second pressure relief valve mechanism (not shown) to provide an automatic venting mechanism of the inflatable bag 109 if, in particular when the buoyancy device 100, attached to the structure to be lifted, is raised through the water. This is required because as the buoyancy device 100 is raised, the surrounding ambient water pressure will reduce, but the air pressure within the inflatable bags 109 will remain the same. Therefore, this automatic venting mechanism allows the buoyancy device 100 to be raised slowly without damage to the inflatable bags 109. However, if the automatic venting mechanism through the second pressure relief valve mechanism is not sufficient, then a second control valve system connected to the air outlet of the inflatable bag 109 provides an applied venting mechanism to vent a greater amount of air. The second pressure relief valve mechanism and the second control valve system together form an inflatable bag 109 deflation system.

Each inflatable bag 109 is provided with an individual control system such that the distribution of air flow input and output from the inflatable bags 109 is controlled individually such that each inflatable bag 109 is a discreet subsystem of the overall buoyancy device 100.

The control system for the inflatable bag 109 is a closed loop feedback system, in which the pressure, displacement and acceleration transducers continually measure the pressure being applied to, and the speed and acceleration of the buoyancy device 100. Also measured is the pressure within each inflatable bag 109 by means of a pressure sensor (not shown) located within each bag 109. These measured quantities are then compared to a pre-determined movement plan held within the computer control system and corrections to the actual movement path of the buoyancy device 100 can then be made by controlled operation of the first and second control valve systems.

In addition to the abovementioned buoyancy control mechanism, additional buoyancy control measures can be used. For example, a "bursting disc" may be incorporated into the outer skin of the inflatable bag 109, the bursting disc comprising a metallic disc which will burst when the differential pressure across the metallic disc face reaches a predetermined level. An example of a bursting disc is a SWAGELOCK(™) bursting disc. Also, by attaching a balance chain, which is well known in the art, the balanced equilibrium of the buoyancy device 100 will be reached at a certain ascent height. Also, a venturi suction system for rapid inflatable bag 109, venting could also be utilised in the buoyancy device 100.

Further, a number of the inflatable bags 9; 109 may be replaced with bags (not shown) which are filled with an incompressible buoyancy material. Examples of such materials are alumina silicate microspheres (a bi-product of the coal fired power generation industry) which contain $C0_2$ gas, bitumen, oil based fluids, fresh water, and other incompressible substances whether fluid or solid which have a density lower than salt sea water which surrounds the buoyancy device. The advantage of providing some of these bags would arise particularly in deploying payloads in deep water. The buoyancy device 2; 100 comprising a number of these bags would be attached to the payload required to be lowered in deep water, such that the payload and buoyancy device 100; 2 combined have a slightly negative buoyancy with respect to the surrounding sea water. Therefore, for a large payload such as a well head Christmas tree, a relatively small crane can be used to deploy the payload.

Modifications and improvements may be made to the foregoing without departing from the scope of the invention.

What is claimed is:

1. A buoyancy device comprising a plurality of buoyancy members substantially equi-spaced around the circumference of a coupling member, the buoyancy members being coupled to the coupling member, wherein at least two of the buoyancy members are inflatable members, the inflatable members being formed from a substantially flexible material, such that the inflatable member substantially collapses when deflated wherein the inflatable member comprises an outer skin of substantially flexible material, the outer skin defining an inner space, and the outer skin comprising a body section and an end section being sealably coupled to both ends of the body section, the body and end sections comprising base edges by means of which the inflatable member is coupled to the coupling member, where the base edges are spaced apart, and where an inflation means inlet and a deflation means outlet are located within a coupling member side wall between the spaced apart base edges.

2. A buoyancy device according to claim 1 wherein the coupling member is coupled to a structure required to be moved in water, in use.

3. A buoyancy device according to claim 1, wherein the coupling member is a tubular member and the inflatable members are coupled along the length of the tubular member.

4. A buoyancy device according to claim 1, further comprising a pressure sensor to sense pressure of the surrounding water.

5. A buoyancy device according to claim 1, further comprising a displacement sensor to measure the displacement of the buoyancy device.

6. A buoyancy device according to claim 1, further comprising an acceleration sensor to measure acceleration of the buoyancy device.

7. A buoyancy device according to claim 1, further comprising a pressure sensor to sense pressure within one or more inflatable member.

8. A buoyancy device according to claim 1, wherein there is provided at least one mechanism to allow regulation of the pressure within an inflatable member.

9. A buoyancy device according to claim 1, further comprising a control system to allow variation of the buoyancy of the inflatable member.

10. A buoyancy device according to claim 9, wherein the control system is connected to, and reads signals from, a surrounding water pressure sensor, an inflatable member pressure sensor, a displacement sensor and an acceleration sensor.

11. A buoyancy device according to claim 10, wherein the control system varies the buoyancy of the inflatable member in response to the signals read.

12. A buoyancy device comprising an array of chambers comprising at least one variable buoyancy chamber and at least one non-variable buoyancy chamber, and means to vary the buoyancy of said variable buoyancy chamber, wherein the array comprises an inner ring of chambers having variable buoyancy and an outer ring of chambers having non-variable buoyancy.

13. A buoyancy device as claimed in claim 12, wherein the variable buoyancy chamber comprises an extensible portion which can be expanded or contracted to increase or decrease the buoyancy of the chamber.

14. A buoyancy device as claimed in claim 12, wherein the means to vary the buoyancy of the variable buoyancy chamber comprises a gas cylinder having an outlet for release of compressed gas into the variable buoyancy chamber.

15. A buoyancy device as claimed in claim 12, further comprising external buoyancy control means to vary the buoyancy of the variable buoyancy chamber from outwith the device.

16. A buoyancy device comprising a plurality of buoyancy members substantially equi-spaced around the circumference of a coupling member, the buoyancy members being coupled to the coupling member, wherein at least two of the buoyancy members are inflatable members, the inflatable members being formed from a substantially flexible material, such that the inflatable member substantially collapses when deflated, wherein the inflatable member comprises an outer skin of substantially flexible material, the outer skin defining an inner space, and the outer skin comprising a body section and an end section being sealably coupled to both ends of the body section, where the body and end sections comprise base edges by means of which the inflatable member is coupled to the coupling member, wherein a coupling device is provided to couple the base edge of the inflatable member to the coupling member and where the coupling device couples one side member of the body section of a first inflatable member in a back-to-back relationship with a side member of the body section of a second inflatable member.

17. A buoyancy device according to claim 16 wherein the coupling member is coupled to a structure required to be moved in water, in use.

18. A buoyancy device according to claim 16, wherein the coupling member is a tubular member and the inflatable members are coupled along the length of the tubular member.

19. A buoyancy device according to claim 16, further comprising a pressure sensor to sense pressure of the surrounding water.

20. A buoyancy device according to claim 16, further comprising a displacement sensor to measure the displacement of the buoyancy device.

21. A buoyancy device according to claim 16, further comprising an acceleration sensor to measure acceleration of the buoyancy device.

22. A buoyancy device according to claim 16, further comprising a pressure sensor to sense pressure within one or more of the inflatable members.

23. A buoyancy device according to claim 16, wherein there is provided at least one mechanism to allow regulation of the pressure within an inflatable member.

24. A buoyancy device according to claim 16, further comprising a control system to allow variation of the buoyancy of the inflatable member.

25. A buoyancy device according to claim 24, wherein the control system is connected to, and read signals from, a surrounding water pressure sensor, an inflatable member pressure sensor, a displacement sensor and an acceleration sensor.

26. A buoyancy device according to claim 25, wherein the control system varies the buoyancy of the inflatable member in response to the signals read.

27. A buoyancy device comprising a plurality of buoyancy members substantially equi-spaced around the circumference of a coupling member, the buoyancy members being coupled to the coupling member, characterised in that at least two of the buoyancy members are inflatable members, the inflatable members being formed from a substantially flexible material, such that the inflatable member substantially collapses when deflated, wherein the coupling member is a tubular member formed from a substantially rigid material, and an inflatable member is provided within the tubular member.

28. A buoyancy device according to claim 27, wherein the coupling member is coupled to a structure required to be moved in water, in use.

29. A buoyancy device according to claim 27, wherein the inflatable members are coupled along the length of the tubular member.

30. A buoyancy device according to claim 27, wherein the inflatable member comprises an outer skin of substantially flexible material, the outer skin defining an inner space, and the outer skin comprising a body section, and an end section being sealably coupled to both ends of the body section.

31. A buoyancy device according to claim 30, wherein the body and end sections comprise base edges by means of which the inflatable member is coupled to the tubular member.

32. A buoyancy device according to claim 31, wherein the base edges of the inflatable members are spaced apart.

33. A buoyancy device according to claim 32, wherein an inflation means inlet and a deflation means outlet are located within a tubular member side wall between the spaced apart base edges.

34. A buoyancy device according to claim 31, wherein a coupling device is provided to couple the base edge of the inflatable members to the tubular member.

35. A buoyancy device according to claim 34, wherein a coupling device couples one side member of the body section of a first of the inflatable members in a back-to-back relationship with a side member of the body section of a second of the inflatable members.

36. A buoyancy device according to claim 27, further comprising a pressure sensor to sense pressure of the surrounding water.

37. A buoyancy device according to claim 27, further comprising a displacement sensor to measure the displacement of the buoyancy device.

38. A buoyancy device according to claim 27, further comprising an acceleration sensor to measure acceleration of the buoyancy device.

39. A buoyancy device according to claim 27, further comprising a pressure sensor to sense pressure within one or more inflatable members.

40. A buoyancy device according to claim 27, wherein there is provided at least one mechanism to allow regulation of the pressure within one of the inflatable members.

41. A buoyancy device according to claim 27, further comprising a control system to allow variation of the buoyancy of at least one of the inflatable members.

42. The buoyancy device according to claim 41, wherein the control system is connected to, and reads signals from, a surrounding water pressure sensor, an inflatable member pressure sensor, a displacement sensor and an acceleration sensor.

43. A buoyancy device according to claim 42, wherein the control system varies the buoyancy of at least one of the inflatable members in response to the signals read.

* * * * *